US009989890B2

(12) United States Patent
Mori

(10) Patent No.: US 9,989,890 B2
(45) **Date of Patent: *Jun. 5, 2018**

(54) DEVELOPING DEVICE AND IMAGE FORMING APPARATUS

(71) Applicant: Brother Kogyo Kabushiki Kaisha, Nagoya-shi, Aichi-ken (JP)

(72) Inventor: Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/397,308

(22) Filed: Jan. 3, 2017

(65) Prior Publication Data

US 2017/0115603 A1 Apr. 27, 2017

Related U.S. Application Data

(63) Continuation of application No. 14/970,075, filed on Dec. 15, 2015, now Pat. No. 9,563,147, which is a (Continued)

(30) Foreign Application Priority Data

Dec. 25, 2009 (JP) ..... 2009-294596
Mar. 10, 2010 (JP) ..... 2010-053661

(51) Int. Cl.
*G03G 15/08* (2006.01)

(52) U.S. Cl.
CPC ..... *G03G 15/0889* (2013.01); *G03G 15/0865* (2013.01)

(58) Field of Classification Search
CPC ..... G03G 15/0812
(Continued)

(56) References Cited

U.S. PATENT DOCUMENTS 5,134,960 A 8/1992 Shirai
5,489,974 A 2/1996 Kamaji et al.
(Continued)

FOREIGN PATENT DOCUMENTS

CN 1728010 A 2/2006
CN 101140441 A 3/2008
(Continued)

OTHER PUBLICATIONS

Apr. 13, 2017—(EP) Extended Search Report—App 16200240.6.
(Continued)

*Primary Examiner* — Susan Lee
(74) *Attorney, Agent, or Firm* — Banner & Witcoff, Ltd.

(57) ABSTRACT

A developing device and an image forming apparatus including the developing device are provided. The developing device includes a housing, a developer carrier which is rotatably supported by the housing, and which carries developer on a circumferential surface thereof, a layer thickness regulating member which includes, a blade contacting the circumferential surface of the developer carrier along a rotational axial direction of the developer carrier, and a support member supporting the blade, the layer thickness regulating member for regulating a layer thickness of the developer on the circumferential surface of the developer carrier. The support member includes: a contact part which contacts the blade; and a pair of attachment parts which are attached to the housing. The attachment parts are provide at both sides of the contact part in the rotational axial direction and are further protruded than the contact part in a direction away from the developer carrier.

4 Claims, 12 Drawing Sheets

Related U.S. Application Data continuation of application No. 14/267,707, filed on May 1, 2014, now Pat. No. 9,316,940, which is a continuation of application No. 12/977,022, filed on Dec. 22, 2010, now Pat. No. 8,737,889.

(58) Field of Classification Search
USPC ..... 399/274, 273, 283, 284
See application file for complete search history.

(56) References Cited

U.S. PATENT DOCUMENTS

| | | | | |
|---|---|---|---|---|
| 5,557,380 | A | 9/1996 | Maeda et al. | |
| 6,336,014 | B1 | 1/2002 | Sato et al. | |
| 6,535,709 | B2 | 3/2003 | Yokomori et al. | |
| 6,549,735 | B2 | 4/2003 | Fujita et al. | |
| 7,292,802 | B2 | 11/2007 | Fukuta et al. | |
| 7,471,921 | B2 | 12/2008 | Fuwazaki et al. | |
| 7,526,225 | B2 | 4/2009 | Fukuta | |
| 7,899,360 | B2 | 3/2011 | Kondo et al. | |
| 8,014,707 | B2 | 9/2011 | Nishiyama et al. | |
| 8,170,442 | B2 | 5/2012 | Sato et al. | |
| 8,737,889 | B2 | 5/2014 | Mori | |
| 2005/0220501 | A1 | 10/2005 | Toba et al. | |
| 2006/0024085 | A1 | 2/2006 | Sato et al. | |
| 2006/0291895 | A1 | 12/2006 | Fukuta et al. | |
| 2008/0025766 | A1 | 1/2008 | Fukuta | |
| 2008/0050153 | A1 | 2/2008 | Mori et al. | |
| 2008/0063439 | A1 | 3/2008 | Kondo et al. | |
| 2009/0169272 | A1 | 7/2009 | Nishiyama et al. | |
| 2009/0180816 | A1 | 7/2009 | Sato et al. | |
| 2009/0190952 | A1 | 7/2009 | Xu et al. | |
| 2010/0150604 | A1* | 6/2010 | Hayashida ..... | G03G 21/1828 399/105 |

FOREIGN PATENT DOCUMENTS

| | | | |
|---|---|---|---|
| CN | 101482716 | A | 7/2009 |
| JP | H07-209985 | A | 8/1995 |
| JP | H07-325481 | A | 12/1995 |
| JP | H08-202145 | A | 8/1996 |
| JP | H10-268600 | A | 10/1998 |
| JP | 11-202618 | A | 7/1999 |
| JP | 2001-281987 | A | 10/2001 |
| JP | 2002-108090 | A | 4/2002 |
| JP | 2002-341644 | A | 11/2002 |
| JP | 2003-076140 | A | 3/2003 |
| JP | 2003-162147 | A | 6/2003 |
| JP | 2005-316423 | A | 11/2005 |
| JP | 2006-039430 | A | 2/2006 |
| JP | 2009-168993 | A | 8/2006 |
| JP | 2007-140041 | A | 6/2007 |
| JP | 2008-051875 | A | 3/2008 |
| JP | 2009175678 | A | 8/2009 |

OTHER PUBLICATIONS

Apr. 19, 2012—(CN) Notification of First Office Action—App 201010623073.8.
Jul. 23, 2012—(CN) Notification of First Office Action—App 201010623067.2.
Jun. 25, 2013—(JP) Notification of Reasons for Refusal—App 2010-053662.
May 28, 2013—(JP) Notification of Reasons for Refusal—App 2010-053661.
Dec. 4, 2014—(US) Non-Final Office Action—U.S. Appl. No. 14/267,707.
Apr. 20. 2015—(US) Final Office Action—U.S. Appl. No. 14/267,707.
Nov. 27, 2015—(EP) Extended Search Report—App 15182378.8.
Sep. 14, 2015—(US) Notice of Allowance—U.S. Appl. No. 14/267,707.
Feb. 3, 2016—(US) Non-Final Office Action—U.S. Appl. No. 14/970,075.
Nov. 11, 2015 (EP) Search Report in 15182378.8-1560.
Jan. 26, 2016 (JP) Office Action in App. 2015-083110.
Jun. 6, 2016—(US) Notice of Allowance—U.S. Appl. No. 14/970,075.
Sep. 27, 2016—(US) Notice of Allowance—U.S. Appl. No. 14/970,075.

* cited by examiner

DEVELOPING DEVICE AND IMAGE FORMING APPARATUS

CROSS-REFERENCE TO RELATED APPLICATION

This application is a continuation of U.S. patent application Ser. No. 14/970,075, filed on Dec. 15, 2015 which is a continuation of U.S. patent application Ser. No. 14/267,707, filed on May 1, 2014, which is a continuation of U.S. patent application Ser. No. 12/977,022, filed on Dec. 22, 2010, which claims priority from Japanese Patent Application Nos. 2009-294596, filed on Dec. 25, 2009, and 2010-053661, filed on Mar. 10, 2010, all of which are incorporated herein by reference.

TECHNICAL FIELD

Aspects of the present invention relate to a developing device that is detachably mounted on an image forming apparatus such as a laser printer, and an image forming apparatus including the developing device.

BACKGROUND

As a developing device, there is known a developing cartridge that is detachably mounted on an image forming apparatus and is configured to develop an electrostatic latent image on a photosensitive drum (for example, refer to JP-A-2008-51875)

The developing cartridge described in JP-A-2008-51875 includes a housing which accommodates toner and rotatably supports a developing roller configured to carry the accommodated toner on a circumferential surface thereof. In forming an image, the developing roller contacts a photosensitive drum over an entire area thereof in a rotational axial direction of the developing roller and is rotated to supply toner to an electrostatic latent image formed on the photosensitive drum. Accordingly, it is possible to develop the electrostatic latent image on the photosensitive drum.

Herein, the developing cartridge is provided with a layer thickness regulating blade which is configured to regulate a thickness (layer thickness) of the toner on the circumferential surface of the developing roller.

Recently, there is a need to reduce the size of the developing cartridge. However, according to the related-art structure of the developing cartridge, a space for providing the layer thickness regulating blade is required, so that it has been not possible to satisfy the need to reduce the size of the developing cartridge.

SUMMARY

Accordingly, an aspect of the present invention is to provide a developing device which can be size-reduced and an image forming apparatus including the developing device.

According to an illustrative embodiment of the present invention, there is provided a developing device comprising: a housing: a developer carrier which is rotatably supported by the housing, and which is configured to carry developer on a circumferential surface thereof; and a layer thickness regulating member which includes: a blade configured to contact the circumferential surface of the developer carrier along a rotational axial direction of the developer carrier; and a support member supporting the blade, the layer thickness regulating member being configured to regulate a layer thickness of the developer on the circumferential surface of the developer carrier. The support member includes: a contact part which contacts the blade; and a pair of attachment parts which are attached to the housing. The attachment parts are provide at both sides of the contact part in the rotational axial direction and are further protruded than the contact part in a direction away from the developer carrier.

According to another illustrative embodiment of the present invention, there is provided an image forming apparatus comprising: the above developing device; a photosensitive body including a circumferential surface, on which an electrostatic latent image is formed; and an exposure unit which is configured to irradiate the circumferential surface of the photosensitive body with light to expose it, thereby forming an electrostatic latent image on the circumferential surface of the photosensitive body. A light path from the exposure unit to the photosensitive body passes between the pair of attachment parts.

According to a further illustrative embodiment of the present invention, there is provided a developing device comprising: a housing including a ceiling wall, a bottom wall, a back side wall, and a pair of sidewalls; a developing roller which is rotatably supported by the pair of sidewalls at both end portions in a rotational axial direction, and which is configured to carry developer on a circumferential surface thereof; a layer thickness regulating member which is configured to regulate a layer thickness of the developer on the circumferential surface of the developing roller. The ceiling wall includes: a first ceiling wall which is provided between the sidewalls and at a side of the bottom wall with respect to an upper end of the sidewalls as viewed from the rotational axial direction; and a second ceiling wall which is provided on the upper end of the sidewalls and an upper end of the back side wall. The layer thickness regulating member is provided on the first ceiling wall from a side opposite to the developing roller with respect to the ceiling wall.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

1. Overall Structure of Printer

Figure 1:
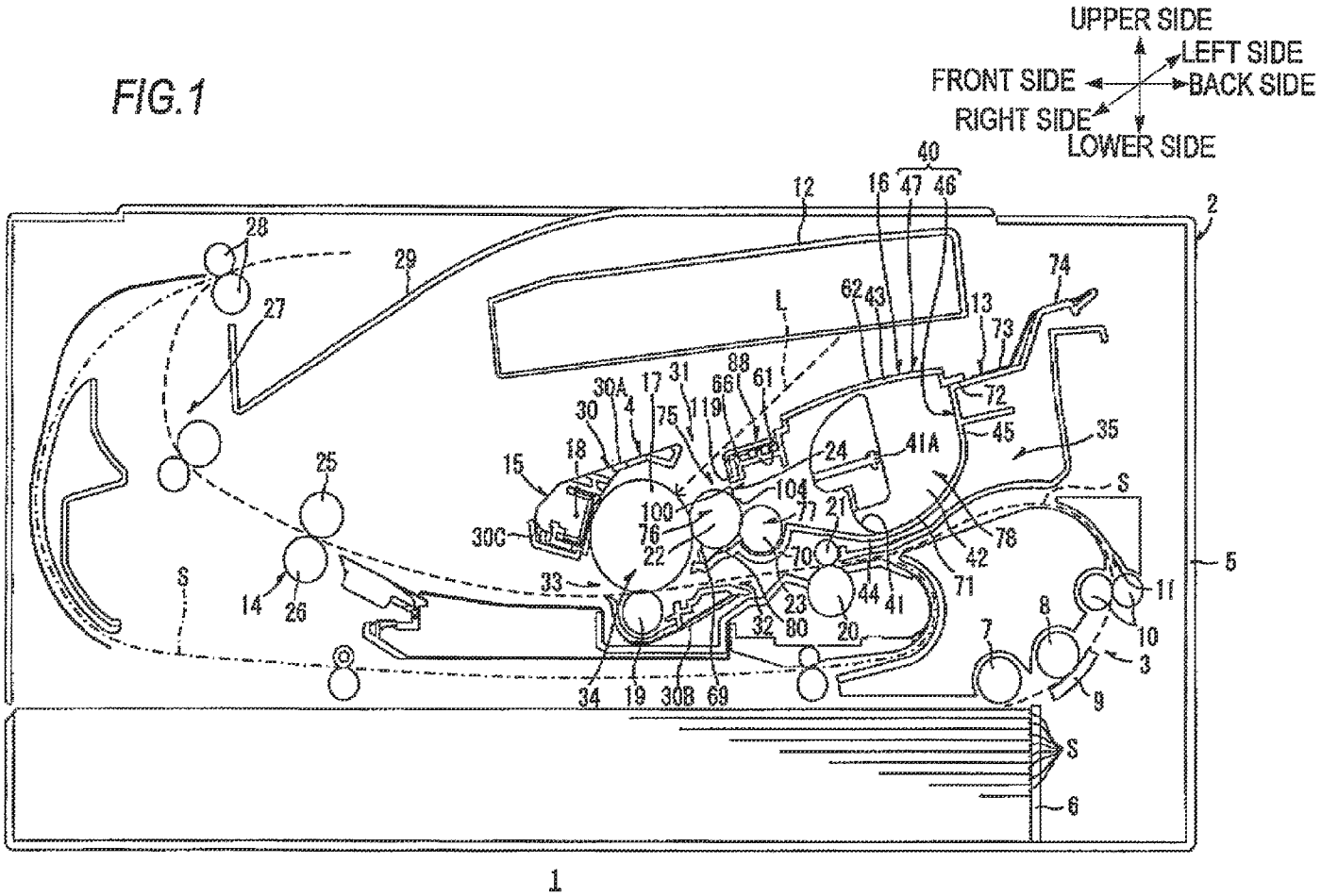
FIG. 1 is a right side sectional view of a printer according to an illustrative embodiment of the present invention.

As shown in FIG. 1, a printer 1 (an example of an image forming apparatus) includes, in a body casing 2, a feeder unit 3 configured to feed a sheet S (an example of a recording medium), and an image forming unit 4 configured to form an image on the fed sheet S.

The body casing 2 has a substantially rectangular box shape, when seen from a side face, and houses the feeder unit 3 and the image forming unit 4. The body casing 2 has a cover 5 at one side wall thereof for mounting and removing a process cartridge 13 (described later). The cover 5 is provided to the body casing 2 so as to be rotatable about a lower end portion as a support point. When the cover 5 is opened, the process cartridge 13 can be mounted on or removed the body casing 2.

In the below descriptions, a side (right side in FIG. 1) to which the cover 5 is provided is referred to as the back side and an opposite side (left side in FIG. 1) is referred to as the front side. In addition, the left and the right are defined when seen from the front side of the printer 1. In other words, the back side of the drawing sheet of FIG. 1 is the left side and the front side of the drawing sheet of FIG. 1 is the right side. Further, a left-right direction may be referred to as a width direction.

The feeder unit 3 is provided at a lower part of the body casing 2. The feeder unit 3 includes a sheet feeding tray 6 that receives sheets S, a pickup roller 7 that is provided above a rear end portion of the sheet feeding tray 6 and a separation roller 8 and a separation pad 9, which are opposed to each other at a back side of the pickup roller 7. In addition, the feeder unit 3 has a pair of front and rear feeder rollers 10, which are opposed to each other above the separation pad 9, a sheet feeding path 11 that extends from an opposing area between both the feeder rollers 10 in a substantially front-upper direction and a main body-side registration roller 20 that is provided at the front side of the sheet feeding path 11.

The sheets S are stacked in the sheet feeding tray 6. The uppermost sheet S is fed to an opposing area between the separation roller 8 and the separation pad 9 by rotation of the pickup roller 7, as indicated by the dotted line. The sheets S are separated one-by-one by the separation roller 8 and the separation pad 9. Then, the sheet S passing through the sheet feeding path 11 by the feeder rollers 10 is conveyed between the main body-side registration roller 20 and a process-side registration roller 21 (described later) and is further conveyed toward between a photosensitive drum 17 (described later; an example of a photosensitive member) and a transfer roller 19 (described later).

In the meantime, separately from the feeder unit 3, there is provided a sheet reverse mechanism that returns the sheet S from a sheet discharge path 27 (described later) toward between the main body-side registration roller 20 and the process-side registration roller 21 (described later) as indicated by the dotted line, so that a two-sided printing can be made with the printer 1.

The image forming unit 4 includes an exposure unit 12, a process cartridge 13 and a fixing unit 14.

The exposure unit 12 is provided at the upper part of the body casing 2. The exposure unit 12 emits light (laser beam indicated by the dotted arrow) toward the photosensitive drum 17 (described later), based on image data, thereby exposing the photosensitive drum 17 (described later).

The process cartridge 13 is detachably received at the lower part of the exposure unit 12 and at the upper part of the feeder unit 3 in the body casing 2. The process cartridge 13 includes a drum cartridge 15 and a developing cartridge 16 (an example of a developing device) detachably attached to the drum cartridge 15.

The drum cartridge 15 includes the photosensitive drum 17, a scorotron-type charger 18 and the transfer roller 19.

The photosensitive drum 17 is long in the width direction and is rotatably provided at a front end portion of the drum cartridge 15 along the left-right direction. The charger 18 is provided to oppose the photosensitive drum 17 at an interval therebetween at the front-upper side of the photosensitive drum 17. The transfer roller 19 is provided to oppose the lower side of the photosensitive drum 17 and is press-contacted to the lower side of the photosensitive drum 17.

In addition, the drum cartridge 15 includes the process-side registration roller 21.

The process-side registration roller 21 is provided to contact the upper side of the main body-side registration roller 20 at a lower part of a substantially center portion in the front-rear direction of the drum cartridge 15.

The developing cartridge 16 includes the developing roller 22 (an example of a developer carrier) which is long in the width direction.

The developing roller 22 is rotatably supported by the developing cartridge 16 at the front end portion thereof so as to be exposed from the front side and is press-contacted to the rear side of the photosensitive drum 17.

In addition, the developing cartridge 16 includes a supply roller 23 which is long in the width direction and is configured to supply toner (an example of developer) to the developing roller 22, and a layer thickness regulating member 24 configured to regulate a thickness of toner supplied on the developing roller 22. Toner is accommodated in a rear space of the supply roller 23 and the layer thickness regulating member 24.

When forming an image, toner in the developing cartridge 16 is supplied to the supply roller 23 and also to the developing roller 22 and is positively friction-charged between the supply roller 23 and the developing roller 22.

A thickness (layer thickness) of toner supplied on the developing roller 22 is regulated by the layer thickness regulating member 24 as the developing roller 22 is rotated, and the toner is carried on the surface (circumferential surface) of the developing roller 22 as a thin layer having a predetermined thickness.

In the meantime, a surface (circumferential surface) of the photosensitive drum 17 is positively and uniformly charged by the charger 18 as the photosensitive drum 17 is rotated and is then exposed by high-speed scanning of the laser beam (refer to the dotted arrow) from the exposure unit 12. Accordingly, an electrostatic latent image that corresponds to an image to be formed on the sheet S is formed on the surface of the photosensitive drum 17.

When the photosensitive drum 17 is further rotated, the positively charged toner, which is carried on the surface of the developing roller 22, is supplied to the electrostatic latent image formed on the surface of the photosensitive drum 17. Accordingly, the electrostatic latent image of the photosensitive drum 17 becomes a visible image and a toner image resulting from reversal development is carried on the surface of the photosensitive drum 17.

When the sheet S conveyed between the photosensitive drum 17 and the transfer roller 19 is passing through between the photosensitive drum 17 and the transfer roller 19, as shown in the dotted line, the toner image carried on the photosensitive drum 17 is transferred onto the sheet S.

The fixing unit 14 is provided at the front side of the process cartridge 13. The fixing unit includes a heating roller 25 and a pressing roller 26 that is opposed to the heating roller 25. The toner image transferred on the sheet S in the process cartridge 13 is heat-fixed on the sheet S by heating and pressing while the sheet S passes through between the heating roller 25 and the pressing roller 26.

The sheet S on which the toner image is fixed passes through the sheet discharge path 27 configured by a U-turn path, as indicated by the dotted line, is conveyed toward the sheet discharge roller 28 and is discharged on a sheet discharge tray 29 by a sheet discharge roller 28. The sheet discharge tray 29 is provided at the upper side of the exposure unit 12.

2. Details of Process Cartridge

(1) Drum Cartridge

Figure 2:
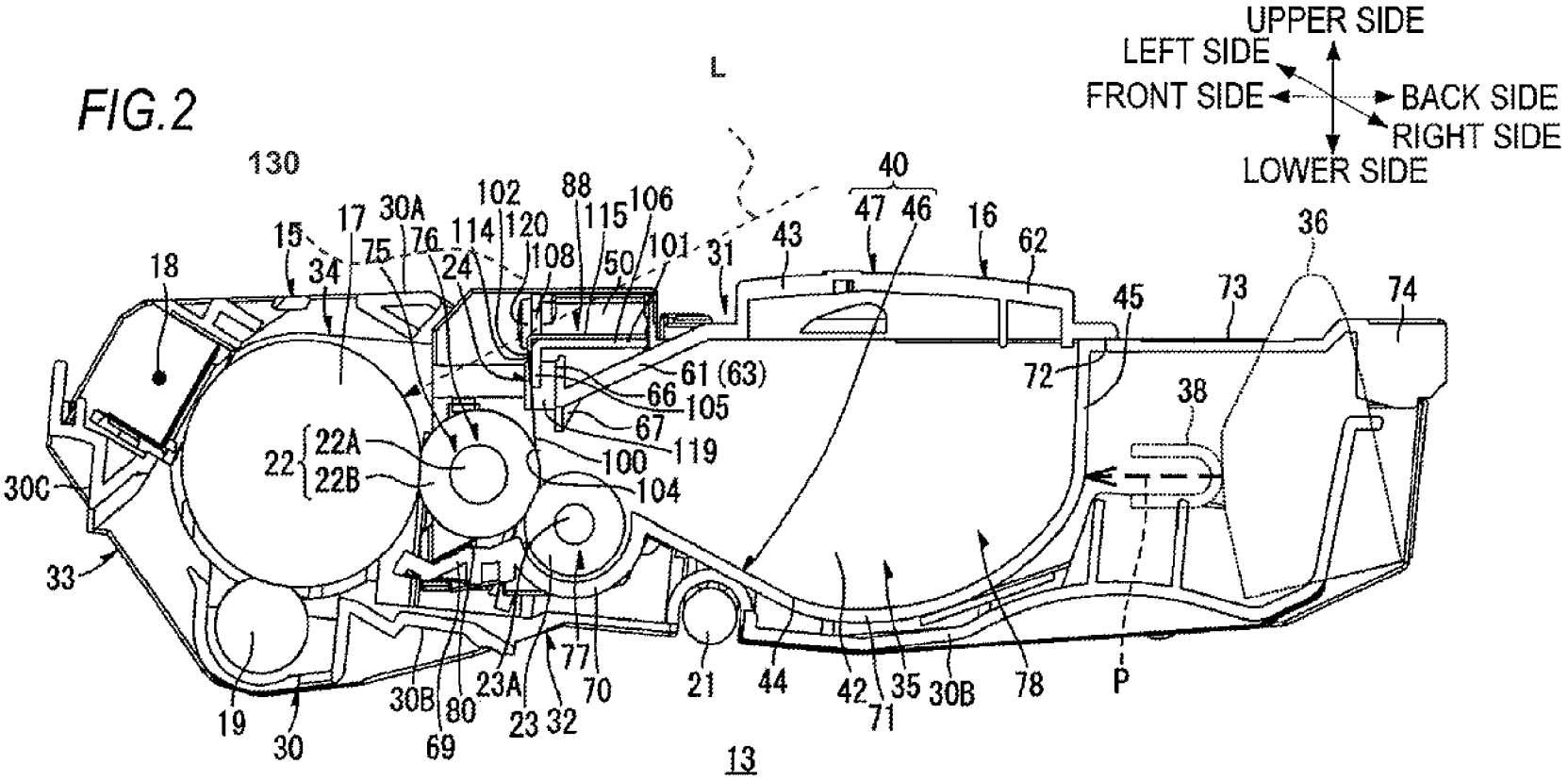
FIG. 2 is a right side sectional view of a process cartridge.

As shown in FIG. 2, the drum cartridge 15 has a substantially rectangular shape having flat upper and lower surfaces, when seen in the width direction. The drum cartridge 15 has a drum frame 30 forming an outer shape thereof.

The drum frame 30 has a hollow box shape having flat upper and lower surfaces. The drum frame 30 includes a ceiling wall 30A formed with an attachment and detachment opening 31, a bottom wall 30B formed with an entrance opening 32 and a front side wall 30C formed with an exit opening 33. The inside of the drum frame 30 communicates with the outside via the attachment and detachment opening 31, the entrance opening 32 and the exit opening 33, respectively.

The attachment and detachment opening 31 is formed at an area about three-fourths from the back side in the ceiling wall 30A. The entrance opening 32 is formed at the front side in the bottom wall 30B from the center thereof. Each of the entrance opening 32 and the exit opening 33 has a width greater than the sheet S (refer to FIG. 1).

The process-side registration roller 21 is rotatably provided at a further back position than the entrance opening 32 in the bottom wall 30B so as to face downward.

The inside of the drum frame 30 is divided into a drum housing chamber 34 occupying an about one-fourth part of the front side and a cartridge housing chamber 35 occupying an about three-fourths part of the back side. The drum housing chamber 34 and the cartridge housing chamber 35 communicate with each other.

The drum housing chamber 34 receives therein the photosensitive drum 17, the charger 18 and the transfer roller 19. The charger 18 is supported at the upper end portion of the front side wall 30C. A back side circumferential surface of the photosensitive drum 17 is opposed to a front side of the cartridge housing chamber 35.

The attachment and detachment opening 31 directly communicates with the cartridge housing chamber 35 from the upper side. A pair of pushing members 36 is provided at an interval in the width direction at the rear end portion of the interior of the cartridge housing chamber 35. Each of the pushing members 36 has a thin plate shape in the width direction and is upwardly thinned when seen from the width direction. Each pushing member 36 is supported by the dram frame 30 (the left and right sidewalls or back side wall of the drum frame 30). Under such a state, each pushing member can be rotated about a rotation axis (not shown) extending in the width direction. In addition, each pushing member 36 is pressed to rotate in a counterclockwise direction by a pressing member (spring and the like), which is not shown, when seen from the width direction.

Once the developing cartridge 16 is received in the cartridge housing chamber 35 from the attachment and detachment opening 31 of the drum frame 30, the attaching of the developing cartridge 16 to the drum cartridge 15 is completed. In the meantime, it is possible to detach the developing cartridge 16 from the drum cartridge 15 by pulling out the developing cartridge 16 received in the cartridge housing chamber 35 through the attachment and detachment opening 31.

In addition, the sheet S (refer to FIG. 1) conveyed from the sheet feeding tray 6 is directed between the photosensitive drum 17 and the transfer roller 19 via the entrance opening 32, as described above (refer to FIG. 1). In the meantime, as described above, the sheet S on which the toner image is transferred is directed to the fixing unit 14 via the exit opening 33 (refer to FIG. 1).

(2) Developing Cartridge

Figure 3:
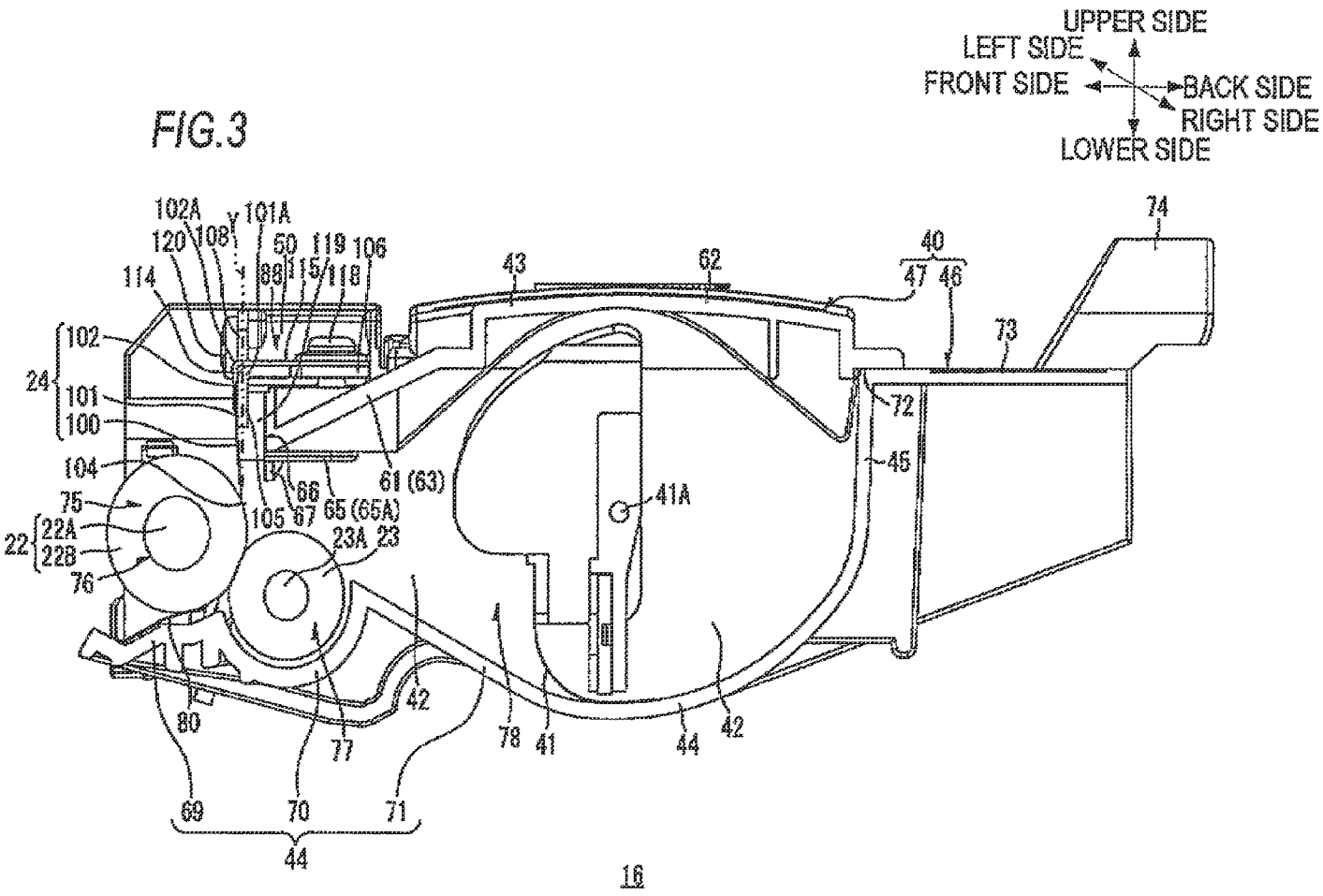
FIG. 3 is a right side sectional view of a developing cartridge.
Figure 4:
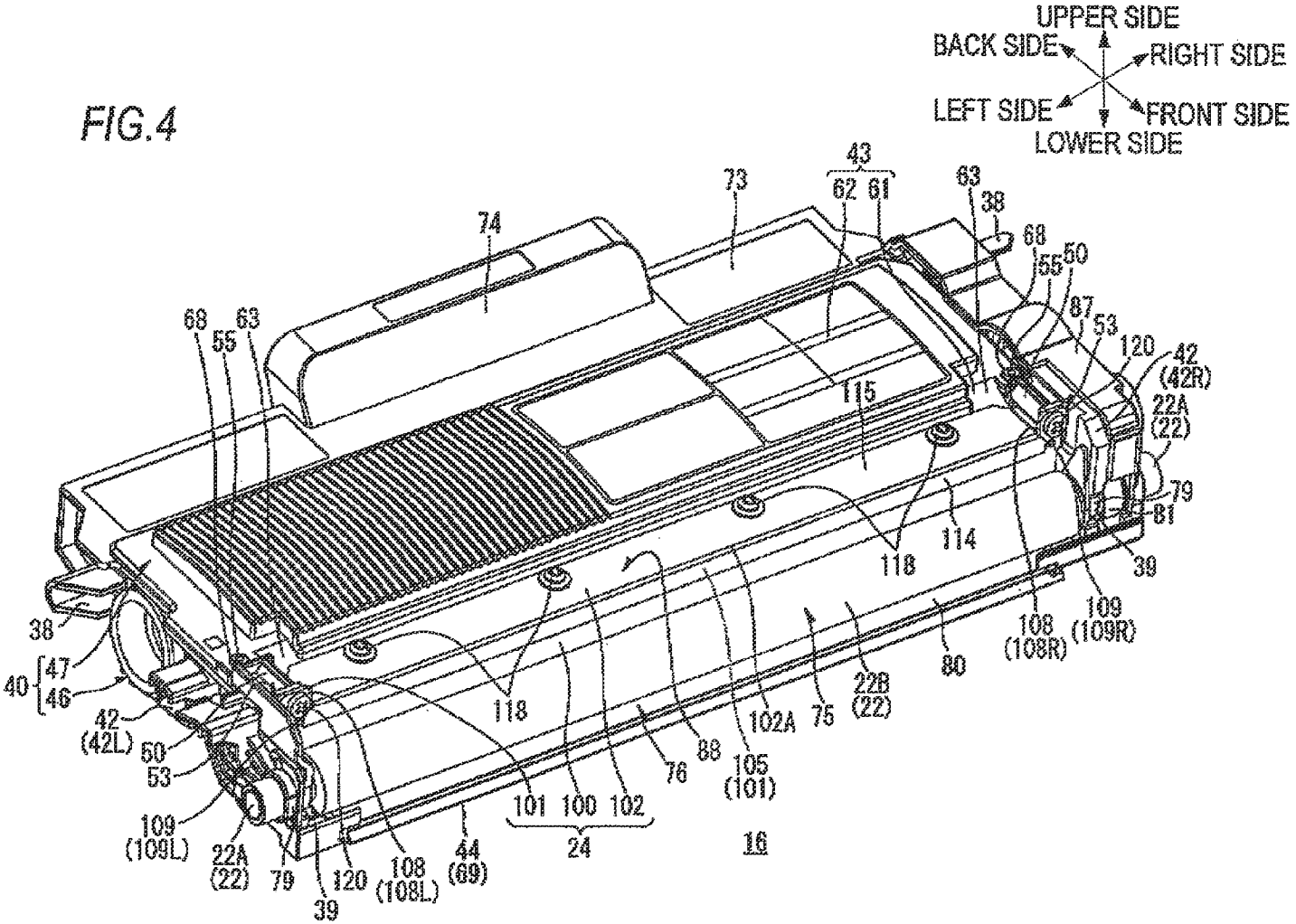
FIG. 4 is a perspective view of the developing cartridge, which is seen from a front-left upper direction.

As shown in FIGS. 3 and 4, the developing cartridge 16 has a box shape which is long in the width direction and has flat upper and lower surfaces. Referring to FIG. 3, the developing cartridge 16 includes a developing frame 40 (an example of a housing), which configures an outer shape of the developing cartridge, the developing roller 22, the supply roller 23, the layer thickness regulating member 24 and an agitator 41.

(2-1) Developing Frame

The developing frame 40 is made of resin and has a box shape which is long in the width direction and has flat upper and lower surfaces. The developing frame 40 includes a pair of sidewalls 42, which are opposed to each other at an interval in the width direction, a ceiling wall 43, a bottom wall 44 and a back side wall 45 (an example of a connection wall).

Figure 5:
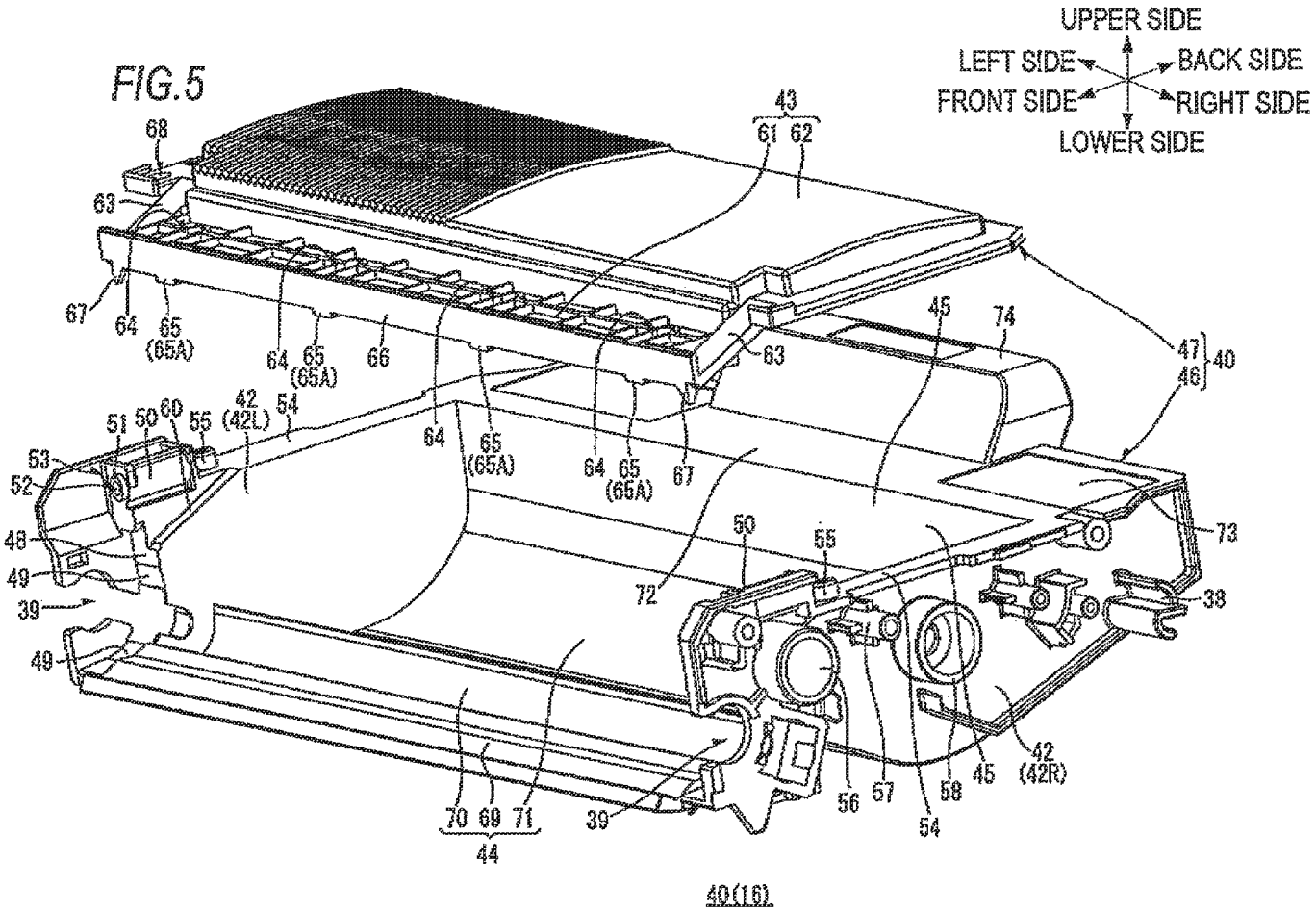
FIG. 5 is an exploded perspective view of a developing frame.

Each sidewall 42 has a substantially rectangular plate shape which is long in the front-rear direction when seen from the width direction and is thin in the width direction. Referring to FIG. 5, each sidewall 42 has a front end portion that is thinner in the width direction than a back side portion provided further back from the front end portion (refer to the left sidewall 42L). That is, a widthwise inner face (a surface facing the inside space of the developing frame 40) of each sidewall 42 is formed with a step portion 48 at a boundary between the front end portion and the back side portion provided further back from the front end portion.

The step portion 48 has an adhesion surface 49 that is bent to form a substantially J shape, when seen from the right side face, and faces the front side.

The step portion 48 has a screw part 50 at an adjacent position above the adhesion surface 49. The screw part 50 has a substantially convex shape and has a front end surface that is flat along the substantially vertical direction. A cylindrical boss 51, which is slightly protruded toward the front side, is integrally provided at an upper position of the front end surface of the screw part 50. A screw hole 52, which is rearwardly extended toward the inside of the screw part 50, is formed at a center position of a circular front end surface of the cylindrical boss 51.

A recess part 53, which is long in the upper-lower direction and is deeply recessed rearward, is formed at a widthwise outer end portion (an further outer position than the boss 51 in the width direction) of the front end surface of the screw part 50.

A flat surface 54, which is elongated in the front-rear direction and is flat in the substantially horizontal direction, is formed at a back side of the upper end edge of each sidewall 42, which is further back side from the screw part 50. A positioning boss 55, which is upwardly protruded, is integrated provided at a front end portion of the flat surface 54. The screw part 50 is further protruded upwardly than the positioning boss 55. Each sidewall 42 is formed with an inclined surface 60 that is inclined in the rear-upper direction and connects a widthwise inner end portion of the upper end portion of the adhesion surface 49 and a widthwise inner end portion of the front end portion of the flat surface 54 (refer to the left sidewall 42L).

Each sidewall 42 is formed with a bearing recess 39 that notches the front end portion of the sidewall from the front end edge toward the back side. Referring to the right sidewall 42R, the bearing recess 39 has a substantially circular shape, when seen from the width direction, and penetrates the right sidewall 42R in the width direction. In the meantime, the bearing recess 39 of the left sidewall 42L includes a circular part same as the bearing recess 39 of the right sidewall 42R and a part that is continuously further extended rearward from the circular part to cut the adhesion surface 49 in the upper-lower direction.

A pushing boss 38, which is outwardly protruded in the width direction, is integrated with a rear end portion of a widthwise outer surface of each sidewall 42.

A first axis 56, a second axis 57 and a third axis 58 are sequentially integrated with an area that is further front than the pushing boss 38 on the right side face of the right sidewall 42R. The axes are protruded rightward in a substantially horizontal direction from the right side face of the sidewall 42R. The first axis 56 and the third axis 58 have a hollow cylindrical shape that has a larger diameter, respectively. The second axis 57 has a hollow cylindrical shape that has a smaller diameter.

The ceiling wall 43 has a plate shape that is placed between the upper end edges of the sidewalls 42 and is thin in the upper-lower direction. The ceiling wall 43 integrally includes a first ceiling wall 61 of a front side having a substantially rectangular shape that is elongated in the width direction and a second ceiling wall 62 of a back side having a substantially rectangular shape that is wider than the first ceiling wall 61, and has a substantially convex shape that is long in the width direction and is narrowed toward the front side, when seen from a plan view.

Both widthwise end portions of the first ceiling wall 61 have inclined walls 63 that are inclined in the front-lower direction (rear-upper direction). However, a part interposed between the inclined walls 63 is flat in a substantially horizontal direction. A plurality of ribs extending in the front-rear direction are formed on an upper surface of the first ceiling wall 61. Further, one rib extending in the left-right direction is formed on the upper surface of the first ceiling wall 61. A plurality of receiving holes 64 (four receiving holes in this illustrative embodiment) are formed at a substantially same interval in the width direction on an upper surface of the part of the first ceiling wall 61 interposed between the inclined walls 63. The receiving holes 64 are long in the front-rear direction, when seen from a plan view. The part of the first ceiling wall 61, on which the receiving holes 64 are formed, has convex portions 65 that are protruded downward, correspondingly to the receiving holes 64. Accordingly, a lower end portion of the convex portion 65 corresponds to the deepest portion of the receiving hole 64.

A front end surface of the first ceiling wall 61 is an opposing surface 66 which is flat along the substantially vertical direction. The opposing surface 66 has a substantially rectangular shape that is elongated in the width direction, when seen from a front face. Herein, the lower end portion 65A of each convex portion 65 is provided up to the opposing surface 66. Therefore, the lower end portions 65A of the four convex portions 65 are provided at a substantially same interval in the width direction at a lower end edge of the opposing surface 66. The front end surfaces of the lower end portions 65A of the respective convex portions 65 are downwardly extended from the lower end edge of the opposing surface 66 with being flush with the opposing surface 66.

Both widthwise end portions of the lower end edge of the opposing surface 66 are integrally provided with positioning protrusions 67 that are downwardly protruded. Each positioning protrusion 67 has a substantially right-angled triangle shape in which a vertically extending side is at the widthwise outer side, when seen from a front face.

Each peripheral part of a left side, a right side and a back side is flat in a substantially horizontal direction on the lower surface of the second ceiling wall 62. Both widthwise end portions of a front end portion of the second ceiling wall 62 are formed with insertion penetration holes 68 that penetrate the second ceiling wall 62 in the upper-lower direction.

The bottom wall 44 has a plate shape that is thin in the upper-lower direction and is extended between the lower end edges of the sidewalls 42, and has a substantially rectangular shape that is long in the width direction, when seen from a plan view.

The bottom wall 44 integrally has a first bottom wall 69, a second bottom wall 70 and a third bottom wall 71 from the front side in order. The third bottom wall 71 occupies an about two-thirds of the back side of the bottom wall 44 (refer to FIG. 3).

The first bottom wall 69 is extended in the front-lower direction (refer to FIG. 3) and is extended between the front sides of the adhesion surfaces 49 of the left and right sidewalls 42. The second bottom wall 70 is continuously extended rearward from a rear end edge of the first bottom wall 69 and is downwardly protruded in a circular arc shape, when seen from the width direction (refer to FIG. 3). The third bottom wall 71 is continuously extended rearward from a rear end edge of the second bottom wall 70 and is downwardly protruded in a circular arc shape, when seen from the width direction (refer to FIG. 3).

The back side wall 45 has a plate shape that is thin in the front-rear direction and has a substantially rectangular shape that is long in the width direction, when seen from a front face. The back side wall 45 is built between rear end edges of the sidewalls 42 to connect the sidewalls 42 while extending in the width direction, and is connected to a rear end edge of the bottom wall 44 (third bottom wall 71). An upper end edge of the back side wall 45 is formed with a flat surface 72 that is elongated in the width direction and is flat in the substantially horizontal direction. The flat surface 72 is continued to rear end portions of the flat surfaces 54 of the upper end edges of the sidewalls 42.

An extension 73 that extends rearward is integrally provided to the upper end edge of the back side wall 45. The extension 73 has a plate shape that is long in the width direction, when seen from a plan view, and an upper surface of the extension is flat in the substantially horizontal direction and is flush with the flat surface 72. A handle 74 that is protruded in the rear-upper direction is integrally provided to a widthwise center portion of a rear end portion of the extension 73.

Herein, regarding the developing frame 40, the parts (sidewalls 42, bottom wall 44 and back side wall 45) except the ceiling wall 43 are integrated to configure the first frame 46, and the ceiling wall 43 configures the second frame 47 and is separate member from the first frame 46. In other words, the developing frame 40 has the first frame 46 and the second frame 47 that can be separated. Herein, the developing frame 40 is made of resin as described above, which means that the first frame 46 and the second frame 47 are also made of resin.

The developing frame 40 is completed by connecting the second frame 47 to the first frame 46. Specifically, as shown in FIG. 5, the second frame 47 is positioned above the first frame 46 and is then lowered to be assembled.

Hence, the left peripheral part of the lower surface of the second ceiling wall 63 of the ceiling wall 43 is surface-contacted to the flat surface 54 of the upper end edge of the left sidewall 42L from the upper, the right peripheral part is surface-contacted to the flat surface 72 of the upper end edge of the right sidewall 42R, from the upper and the back side peripheral part is surface-contacted to the flat surface 72 of the upper end edge of the back side wall 45 from the upper. In addition, regarding the first ceiling wall 61 of the ceiling wall 43, the left inclined wall 63 is surface-contacted to the inclined surface 60 of the left sidewall 42L, from the upper, and the right inclined wall 63 is surface-contacted to the inclined surface 60 of the right sidewall 42R from the upper. In addition, as shown in FIG. 6, the first ceiling wall 61 is placed between the lower end portions of the left and right screw parts 50.

At this time, the positioning bosses 55 of the sidewalls 42 are inserted into the insertion penetration holes 68 of the second ceiling wall 62 from the lower and the positioning protrusions 67 of the opposing surface 66 of the first ceiling wall 61 are contacted to the widthwise inner sides of the sidewalls 42. Thereby, the position of the second frame 47 with respect to the first frame 46 is determined.

In this state, the surface-contact parts of the first frame 46 and the second frame 47 are connected by an adhesive or ultrasonic welding without a gap, the second frame 47 is connected to the sidewalls 42 and the back side wall 45 of the first frame 46 (refer to FIG. 3), so that the developing frame 40 is completed.

Figure 6:
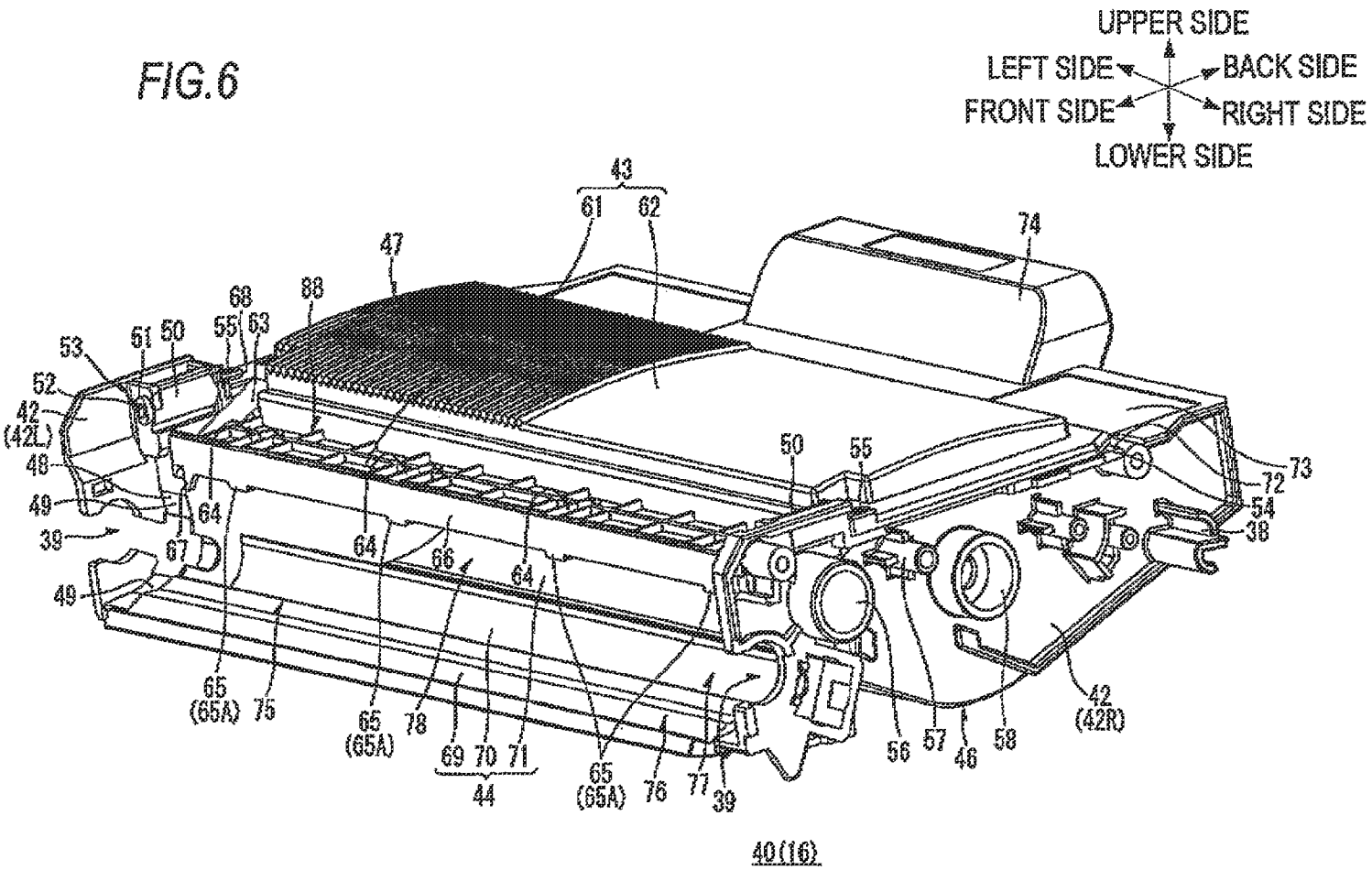
FIG. 6 is a perspective view of the completed developing frame, which is seen from a front-right upper direction.

As shown in FIG. 6, in the completed developing frame 40, the front end portion of the ceiling wall 43 is retreated rearward by the amount of the first bottom wall 69 from the front end portions of the sidewalls 42 and the bottom wall 44. In addition, the opposing surface 66 of the ceiling wall 43 is provided between the lower end portions of the left and right screw parts 50, at the rearward retreated position from the front end surfaces of the left and right screw parts 50. In addition, the ceiling surface of the developing frame 40 is formed with a recess part 88 that is defined between the first ceiling wall 61 which is placed between the lower end portions of the left, and right screw parts 50, and that is downwardly recessed.

The front side face of the completed developing frame 40 is formed with an opening 75 that is elongated in the width direction. The opening 75 is defined by each front end portion of the sidewalls 42, the ceiling wall 43 and the bottom wall 44 and communicates with an inner space of the developing frame 40.

Referring to FIG. 3, the inner space of the developing frame 40 between the sidewalls 42 is divided into a developing roller housing chamber 76, a developing chamber 77 and a toner accommodating chamber 78. The developing roller housing chamber 76, the developing chamber 77 and the toner accommodating chamber 78 are sequentially arranged from the front side, and the rooms, which are adjacent to each other in the front-rear direction, communicate with each other. A lower end portion of the developing roller housing chamber 76 is defined by the first bottom wall 69, a lower end portion of the developing chamber 77 is defined by the second bottom wall 70 and a lower end portion of the toner accommodating chamber 78 is defined by the third bottom wall 71. Toner is accommodated in the toner accommodating chamber 78. In addition, the left and right screw parts 50 are at the same position as the developing chamber 77 in the front-rear direction.

(2-2) Developing Roller. Supply Roller and Agitator

The developing roller 22 is received in the developing roller housing chamber 76, the supply roller 23 is received in the developing chamber 77 and the agitator 41 is received in the toner accommodating chamber 78.

The developing roller 22 has a cylindrical roller axis 22A extending in the width direction and a cylindrical rubber roller 22B covering a part of the roller axis 22A except both widthwise end portions of the roller axis. The both widthwise end portions of the roller axis 22A are fitted into the bearing recesses 39 (refer to FIG. 5) via bearings 79, respectively, (refer to FIG. 4) from the front side. In this state, both widthwise end portions of the developing roller 22 are rotatably supported, via the bearings 79 at the both widthwise end portions of the roller axis 22A, by the left and right sidewalls 42 (refer to FIG. 4). In other words, the developing roller 22 can be rotated about the rotation axis (roller axis 22A) extending in the width direction and a direction of the rotation axis of the developing roller 22 is the width direction.

In this state, an upper surface (a surface facing the lower circumferential surface of the developing roller 22) of the first bottom wall 69 is mounted with a lower film 80. The lower film 80 is a film that is made of a material having flexibility such as PET sheet or rubber sheet and has a rectangular shape elongated in the width direction, and is extended in the rear-upper direction, when seen from the width direction. An end portion of a rear-upper side of the lower film 80 is contacted to the lower circumferential surface of the rubber roller 22B of the developing roller 22 over the entire widthwise area thereof. Thereby, a gap between the developing roller 22 and the first bottom wall 69 is sealed.

In addition, the adhesion surface 49 (refer to FIG. 6) of the widthwise inner side of each sidewall 42 of the developing frame 40 is adhered with a side seal (not shown) having a band shape and made of an elastic member such as felt, sponge and the like. The side seals adhered to the left and right adhesion surfaces 49 are contacted to both widthwise end portions of the back side circumferential surface of the developing roller 22 (rubber roller 22B), respectively, from the back side to seal between the adhesion surfaces 49 and the circumferential surfaces of the widthwise end portions of the rubber roller 22B, without a gap.

The both widthwise end portions of the supply roller 23 are rotatably supported by the sidewalls 42. A right end portion of a rotation axis 23A of the supply roller 23 is exposed from the right side face of the right sidewall 42R (refer to FIG. 7A).

The agitator 41 can be rotated in the counterclockwise direction about a rotation axis 41A extending in the width direction between the left and right sidewalls 42, when seen from a right side face. A right end portion of the rotation axis 41A is exposed through the right side face of the right sidewall 42R from the inner part of the hollow cylindrical third axis 58 (refer to FIG. 5) (refer to FIG. 7A).

Figure 7A:
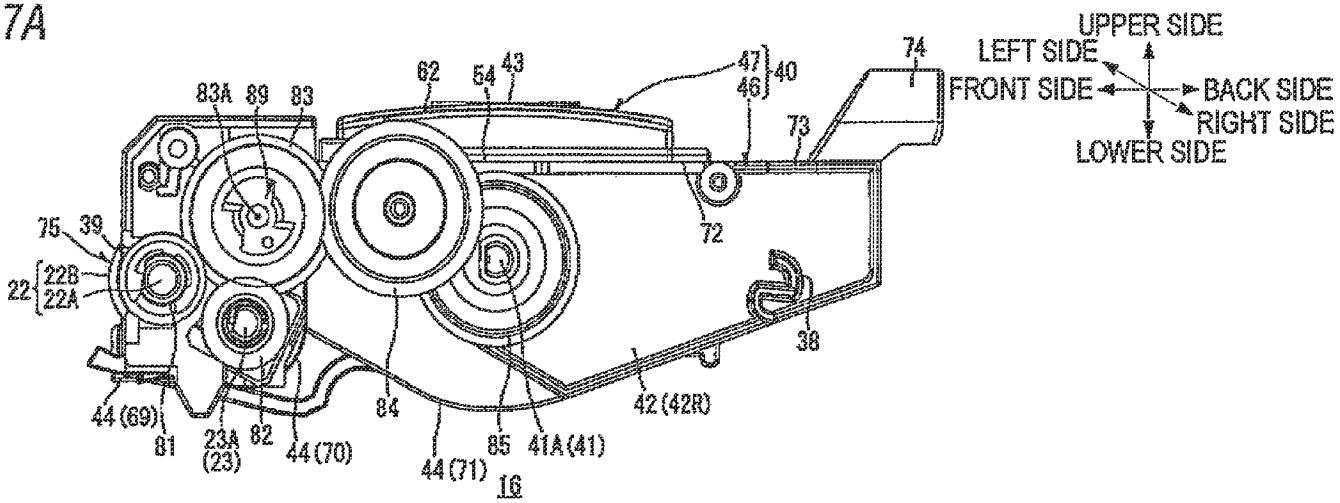
FIG. 7A is a right side view of the developing cartridge.

Herein, configurations for rotating the developing roller 22, the supply roller 23 and the agitator 41 will be described. As shown in FIG. 7A, the right side face (right side end portion of the developing frame 40) of the right sidewall 42R is provided with a developing roller gear 81, a supply roller gear 82, a coupling gear 83 (an example of a coupling member), a relay gear 84 and an agitator gear 85. These gears have a circle shape, when seen from a right side face, and have gear teeth on a circumferential surface, respectively. In the meantime, the gears are typically covered and protected by a cover 87 (refer to FIG. 4) provided to the right sidewall 42R.

The right end portion of the roller axis 22A of the developing roller 22 is fixed to a center of the developing roller gear 81 so that it cannot be relatively rotated. The right end portion of the rotation axis 23A of the supply roller 23 is fixed to a center of the supply roller gear 82 so that it cannot be relatively rotated. The right end portion of the rotation axis 41A of the agitator 41 is fixed to a center of the agitator gear 85 so that it cannot be relatively rotated.

The first axis 56 (refer to FIG. 5) is inserted into a center of the coupling gear 83 from the left side, and the second axis 57 (refer to FIG. 5) is inserted into a center of the relay gear 84 from the left side. In this state, the coupling gear 83 and the relay gear 84 are rotatably supported by the corresponding first axis 56 (refer to FIG. 5) or second axis 57 (refer to FIG. 5).

In this state, the developing roller gear 81 meshes with the coupling gear 83 from the front side, the supply roller gear 82 meshes with the coupling gear 83 from the lower side and the relay gear 84 meshes with the coupling gear 83 from the rear side and with the agitator gear 85 from the front side.

Herein, a right end surface of the coupling gear 83 is formed with a coupling part 89 that is recessed leftward and the coupling part 89 is typically exposed rightward from the cover 87 (refer to FIG. 4). Specifically, the coupling part 89 includes a cylindrical wall which stands rightward and two projecting parts which project from the cylindrical wall in a radial direction thereof. In addition, the body casing 2 (refer to FIG. 2) is provided with a coupling member (not shown; an example of a driving-side coupling member) connected to a driving source (not shown: for example, motor).

In the state (refer to FIG. 1) where the developing cartridge 16 is mounted on the body casing 2, the coupling member (not shown) is moved leftward and fitted in the coupling part 89. Thereby, the coupling gear 83 is connected to the external coupling member (not shown) in the width direction. Thus, when the driving source (not shown) generates driving force in the corresponding state, the coupling gear 83 (the projecting parts of the coupling part 89) is applied with the driving force and is thus rotated.

As a result, the developing roller gear 81, the supply roller gear 82 and the relay gear 84, which are meshed with the coupling gear 83, are rotated and the agitator gear 85 meshed with the relay gear 84 is rotated. As the developing roller gear 81, the supply roller gear 82 and the agitator gear 85 are rotated, the developing roller 22, the supply roller 23 and the agitator 41 are also rotated. Accordingly, the coupling gear 83 transmits the driving force to the developing roller 22, the supply roller 23 and the agitator 41.

Here, when seen from a right side face, the developing roller 22 and the supply roller 23 are rotated in the counterclockwise direction and the agitator 41 is rotated in the clockwise direction (refer to FIG. 3).

Figure 7B:
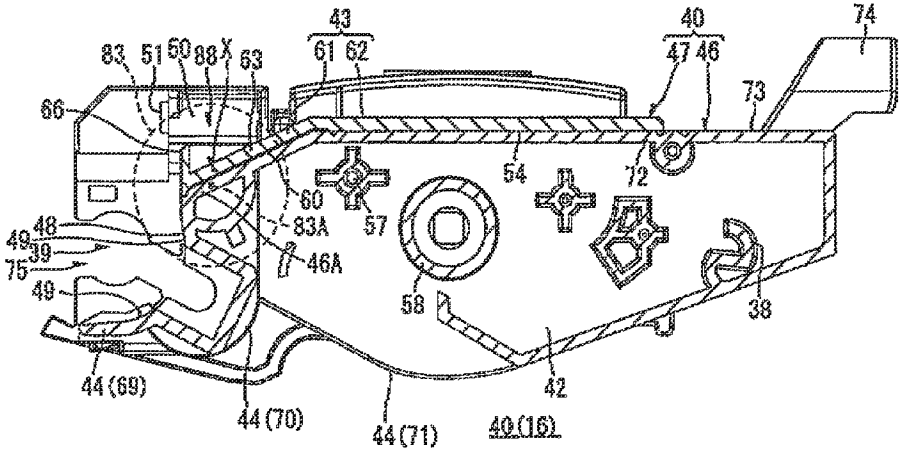
FIG. 7B is a right side sectional view of the developing cartridge.

Referring to FIG. 7B, in the developing frame 40, a sectional face of the first frame 41 is a obliquely hatched part extending in the right-upper direction and a sectional face of the second frame 47 is a obliquely hatched part extending in the right-lower direction.

In FIG. 7B, as viewed from the width direction, the coupling gear 83 indicated by the dotted line is overlapped with the connection part X between the first frame 46 and the second frame 47 (strictly, the inclined surface 60 of the first frame 46 and the inclined surface 63 of the second frame 47). Specifically, as viewed from the width direction, a rotation center 83A of the coupling gear 83 is overlapped with at least one of the first frame 46 and the second frame 47 (herein, a thick part 46A of the first frame 46 in the inclined surface 60) in the connection part X.

(2-3) Layer Thickness Regulating Member

Figure 8:
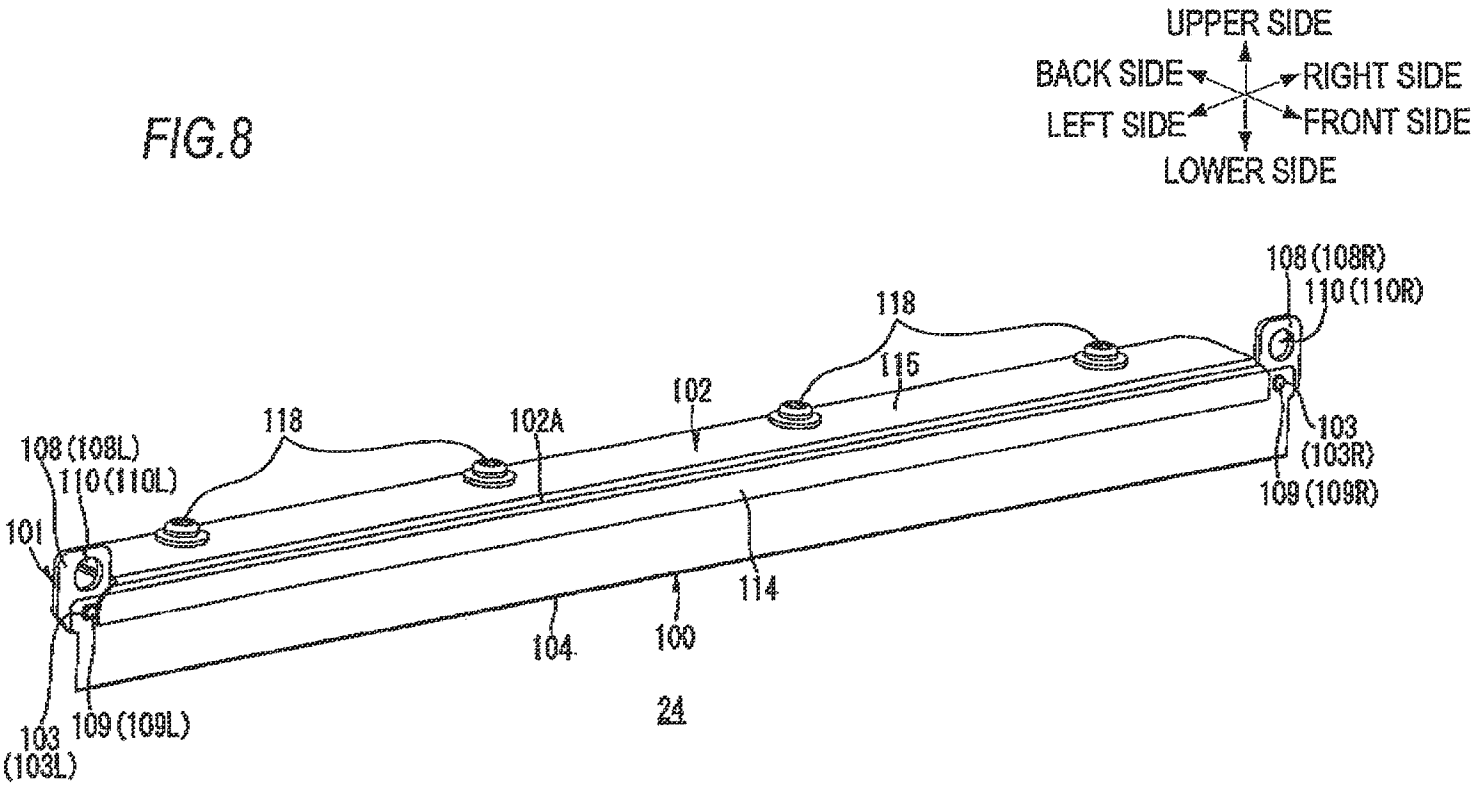
FIG. 8 is a perspective view of a layer thickness regulating member, which is seen from a front-left upper direction.

Referring to FIG. 8, the layer thickness regulating member 24 includes a blade 100 configured to regulate a thickness of toner supplied to the developing roller 22, a support member 101 that supports the blade 100 and a reinforcement member 102 that reinforces the blade 100.

Figure 9:
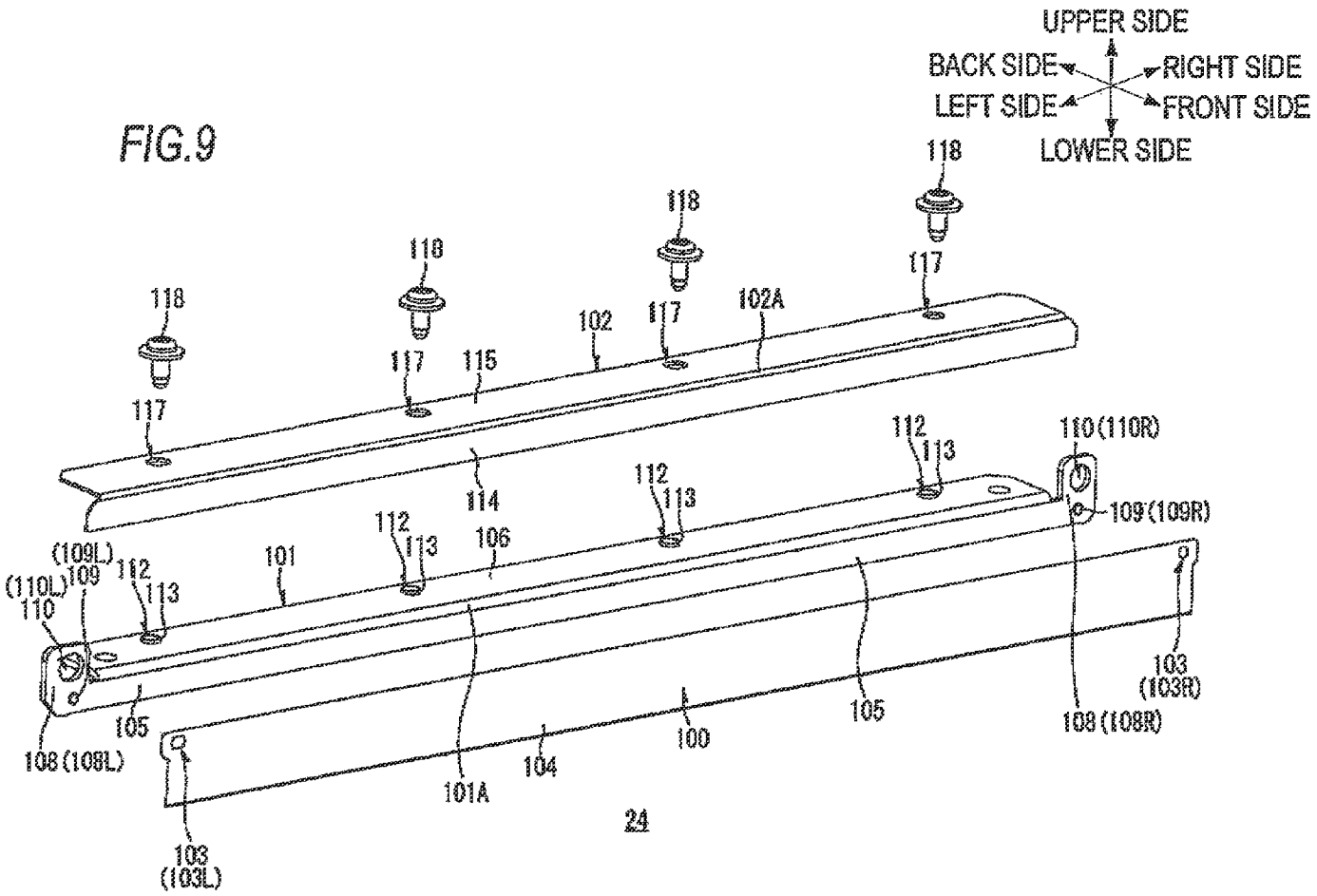
FIG. 9 is an exploded perspective view of the layer thickness regulating member.

Referring to FIG. 9, the blade 100 has a plate shape that is thin in the front-rear direction and has a substantially rectangular shape that is elongated in the width direction, when seen from a front face. The blade 100 is made of metal having elasticity. A widthwise dimension of the blade 100 is substantially the same as that of the rubber roller 22B of the developing roller 22 (refer to FIG. 4). An upper end portion of the blade 100 has a width slightly greater than that of a portion below the upper end portion.

Both widthwise end portions of the upper end portion of the blade 100 are formed with penetration holes 103 that penetrate the blade 100 in the thickness direction (front-rear direction) thereof. The left penetration hole 103L is a long hole which is long in the width direction and the right penetration hole 103R is a circular hole. A lower end portion of the blade 100 is bent rearward in a circular arc shape toward a lower end edge, over the entire widthwise area (refer to FIG. 10).

The support member 101 is formed by bending a metal plate, which is elongated in the width direction, into a L-shape, as viewed from the width direction. The metal plate configuring the support member 101 is made of metal having high rigidity (i.e., metal that is not easily bent) and has a thickness thicker than that of the blade 100. Therefore, the support member 101 is very hard.

The support member 101 is bent into a substantially right angle about a bending portion 101A and integrally includes a first support part 105 (an example of a contact part or a first part), which is located at one side (a lower side in FIG. 9) with respect to the bending portion 101A, and a second support part 106 (an example of a second part), which is located at the other side (a rear side in FIG. 9).

The first support part 105 has a substantially rectangular plate shape that is thin in the front-rear direction and is elongated in the width direction, when seen from a front face. A widthwise dimension of the first support part is substantially the same as the widthwise dimension of the blade 100. Front and back side faces of the first support part 105 are flat in the substantially vertical direction. Both widthwise end portions of the front side face of the first support part 105 are integrally provided with cylindrical convex parts 109 protruding to the front side.

Both widthwise end portions of the first support part 105 are integrally provided with protrusions 108 (an example of an attachment part or a third part) which protrudes from an upper end edge of the first support part 105 to the upper side. Each of the protrusions 108 has a thin plate shape having the same thickness as the first support part 105. In each of the protrusions 108, a front side face thereof is flush with the front side face of the first support part 105 and a back side face thereof is flush with the back side face of the first support part 105. Therefore, as viewed from the width direction, the left and right protrusions 108 and the first support part 105 are provided on a same plane Y (refer to FIG. 10) extending in the vertical direction. The left and right protrusions 108 is a part of the first support part 105.

Each protrusion 108 has a substantially rectangular shape, when seen from a front face. Each protrusion 108 is formed with an attachment hole 110 that penetrates the protrusion 108 in the thickness direction (front-rear direction) thereof. The attachment hole 110L of the left protrusion 108L is a long hole which is long in the width direction and the attachment hole 110R of the right protrusion 108R is circular.

The second support part 106 is thin in the upper-lower direction and has a substantially rectangular plate shape that is elongated in the width direction, when seen from a plan view. A widthwise dimension of the second support part is slightly smaller than a distance between the left and right protrusions 108. Upper and lower side faces of the second support part 106 are flat in the substantially horizontal direction. In other words, since the second support part 106 is extended in the substantially horizontal direction, the second support part is located on a plane intersecting with the plane Y (refer to FIG. 10) extending in the vertical direction, as viewed from the width direction.

The second support part 106 is formed with a plurality of screw holes 112 (four screw holes in this illustrative embodiment) at an interval in the width direction, each of which penetrates the second support part 106 in the thickness direction (upper-lower direction) thereof. An upper side face of the second support part 106 is integrally provided with ring-shaped bosses 113 each of which slightly protrudes upwardly while forming an edge along the screw hole 112.

The reinforcement member 102 is formed by bending a metal plate, which is elongated in the width direction, into an L-shape, as viewed from the width direction, likewise the support member 101. The metal plate configuring the reinforcement member 102 is made of metal having high rigidity (i.e., metal that is not easily bent) and has a thickness thicker than that of the blade 100. Therefore, the reinforcement member 102 is very hard.

The reinforcement member 102 integrally has a first reinforcement part 114, which is located at one side (a lower side in FIG. 9) with respect to a bending portion 102A, and a second reinforcement part 115, which is located at the other side (a rear side in FIG. 9) with respect to the bending portion 102A. The reinforcement member 112 is bent into an angle that is slightly smaller than 90° about the bending portion 102A. Therefore, an angle between the first reinforcement part 114 and the second reinforcement part 115 is slightly smaller than 90°.

The first reinforcement part 114 has a substantially rectangular plate shape that is thin in the front-rear direction and is elongated in the width direction, when seen from a front face. A widthwise dimension of the first reinforcement part is substantially the same as the widthwise dimension of the second support part 106. Strictly, the widthwise dimension of the first reinforcement part 114 is formed so that a width of its upper end portion is narrower a little. Front and back side faces of the first reinforcement part 114 are flat in the substantially vertical direction.

The second reinforcement part 115 has a substantially rectangular plate shape that is thin in the upper-lower direction and is elongated in the width direction, when seen from a plan view. A widthwise dimension of the second reinforcement part is substantially the same as the widthwise dimension of the upper end portion of the first reinforcement part 114. Upper and lower side faces of the second reinforcement part 115 are flat in the substantially horizontal direction.

The second reinforcement part 115 is formed with a plurality of insertion penetration holes 117 (four in this illustrative embodiment) at an interval in the width direction, each of which penetrates the second reinforcement part 115 in the thickness direction (upper-lower direction) thereof. An interval between the insertion penetration holes 117 adjacent to each other in the width direction is the same as that of the screw holes 112 adjacent to each other in the width direction. Among the four insertion penetration holes 117, only the insertion penetration hole 117 at the right end portion is circular and the other three insertion penetration holes 117 are long holes which are long in the width direction.

When assembling the layer thickness regulating member 24 having the blade 100, the support member 101 and the reinforcement member 102, the blade 100, the support member 101 and the reinforcement member 102 are first placed as shown in FIG. 9.

Then, the blade 100 is attached to the front side of the support member 101. In the attachment, the right convex part 109R of the support member 101 is inserted into the right penetration hole 103R of the blade 100 from the back side of the blade, thereby positioning the right part of the blade 100 at the right part of the first support part 105 of the support member 101. After that, the blade 100 is inclined rearward about the penetration hole 103R serving as a supporting point.

Then, the left convex part 109L of the support member 101 is inserted into the left penetration hole 103L of the blade 100 from the back side of the blade, thereby positioning the left part of the blade 100 at the left part of the first support part 105. Thereby, the blade 100 is positioned with regard to the first support part 105 of the support member 101 and a substantial upper side half part of the back side face of the blade 100 is surface-contacted to the front side face of the first support part 105 over the entire widthwise area.

Herein, since the left penetration hole 103L is a long hole, the left convex part 109L is certainly inserted into the left penetration hole 103L even when there is an error in the distance between the convex part 109R and the convex part 109L. In addition, the front end portion of each convex part 109 inserted into the corresponding penetration holes 103 is protruded forward from the front side face of the blade 100 in the thickness direction (front-rear direction) of the blade 100.

Next, the reinforcement member 102 is provided so that the first reinforcement part 114 is located at a further front position than the blade 100, and then is lowered. Hence, the first reinforcement part 114 of the reinforcement member 102 is lowered while being opposed to the front side of the blade 100 and the second reinforcement part 115 is lowered between the left and right protrusions 108 of the first support part 105 while being opposed to the upper side of the second support part 106.

When the second reinforcement part 115 is contacted to the second support part 106 from the upper, the lowering of the reinforcement part 102 is stopped. At this stage, the first reinforcement part 114 is opposed to the substantially upper side half part of the blade 100 from the front side. In addition, regarding each screw hole 112 (boss 113) of the second support part 106, the insertion penetration holes 117 of the second reinforcement part 115 located at the same position in the width direction are slightly displaced in the front direction. In addition, the first reinforcement part 114 is located between the left and right convex parts 109 inserted into the penetration holes 103.

In this state, the screws 118 are inserted into the respective insertion penetration holes 117 and then into the corresponding screw holes 112 from the upper. Hence, as the screw 118 is assembled into the screw hole 112, the screw 118 (a lower side part, rather than a head part thereof) presses rearward a part of a border along the circumferential edge of the rear side of the insertion penetration hole 117 of the second reinforcement part 115. Thus, by the time when the assembling of the screws 118 to the screw holes 112 is almost completed, the insertion penetration holes 117 conform to the screw holes 112 (bosses 113), when seen from a plan view, and the bosses 113 are fitted into the insertion penetration holes 117 from the lower.

Here, since the three left insertion penetration holes 117 are long holes, all the bosses 113 are securely fitted into the corresponding insertion penetration holes 117 even when there is an error in the distance between the bosses 113.

Figure 10:
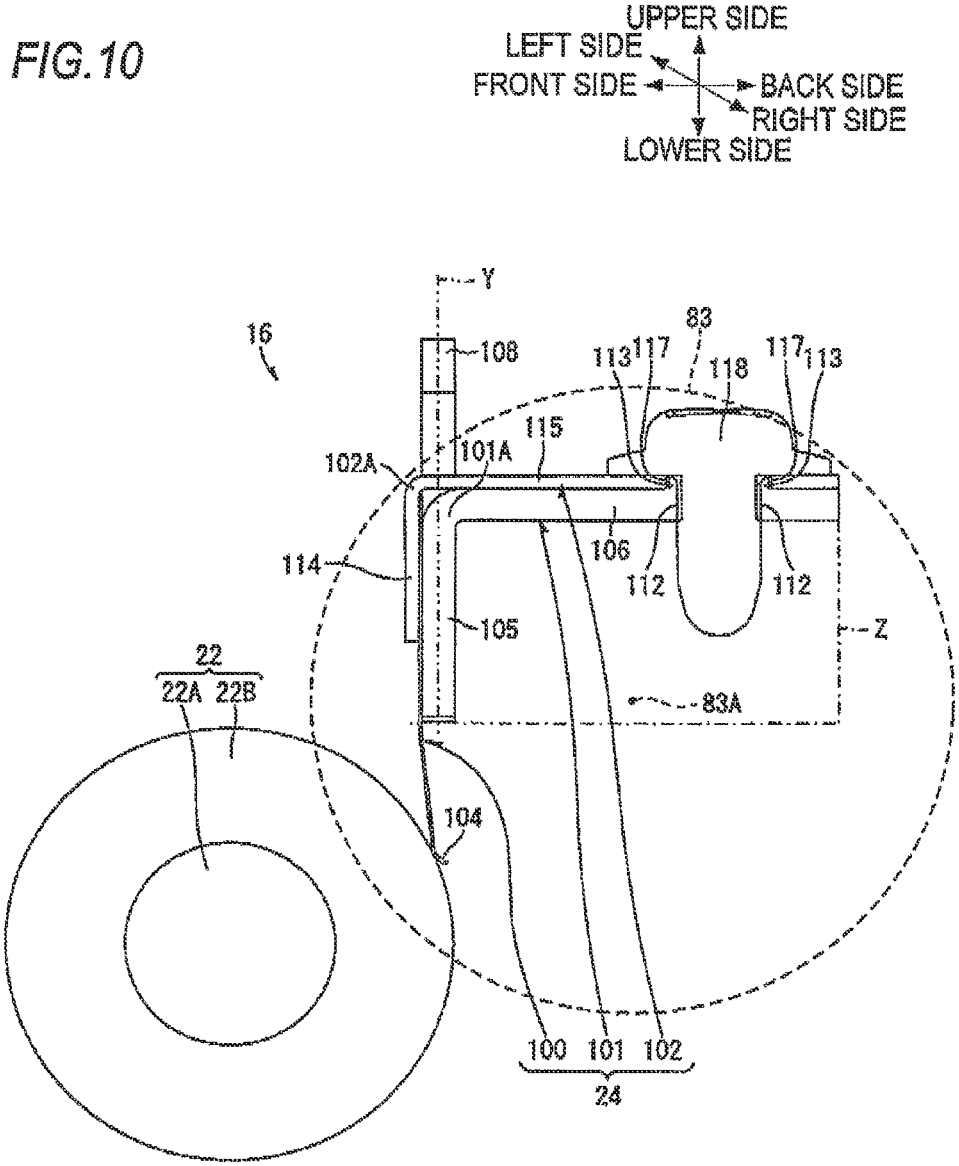
FIG. 10 is a right side sectional view of the layer thickness regulating member and a developing roller.

As each boss 113 is fitted into the insertion penetration hole 117, the reinforcement member 102 is positioned with respect to the support member 101 and the second reinforcement part 115 is surface-contacted to the second support part 106 from the upper (refer to FIG. 10).

As shown in FIG. 10, when the screw 118 is completely assembled into the screw hole 112, the second support part 106 of the support member 101 and the second reinforcement part 115 of the reinforcement member 102 are attracted each other by the screws 118 and thus fixed to each other (assembled). At this time, a substantially lower side half part of each screw 118 is downwardly protruded from the screw hole 112 of the second support part 106. As a result, as shown in FIG. 8, the assembling of the layer thickness regulating member 24 is completed.

Herein, referring to FIG. 10, as described above, the angle between the first reinforcement part 114 and the second reinforcement part 115 in the reinforcement member 102 is slightly smaller than 90°. Therefore, at the early stage of the assembling of the screws 118 into the screw holes 112, the first reinforcement part 114 is slightly inclined in the rear-lower direction toward the blade 100. In this case, when the screws 118 are gradually assembled into the screw holes 112, the screws 118 press rearward the second reinforcement part 115, as described above. Accordingly, the upper end portion of the first reinforcement part 114 is attracted rearward by the second reinforcement part 115.

Thereby, when the assembling of the screws 118 into the screw holes 112 (the assembling of the layer thickness regulating member 24) is completed, the first reinforcement part 114 is extended in the vertical direction even though the first reinforcement part is originally inclined in the rear-lower direction. However, under this state, since the first reinforcement part 114 is inclined in the rear-lower direction by the self-restoring force and thus always presses the substantially upper side half part of the blade 100 in the rear direction, the substantially upper side half part of the blade 100 is strongly sandwiched by the first reinforcement part 114 and the first support part 105 in the front-rear direction. In other words, the blade 100 is contacted and fixed to the first reinforcement part 114 and the first support part 105. In addition, the reinforcement member 102 reinforces the substantially upper side half part of the blade 100 by sandwiching the substantially upper side half part of the blade 100 between the first reinforcement part 114 and the first support part 105.

Accordingly, when the assembling of the layer thickness regulating member 24 is completed, the first support part 105 and the first reinforcement part 114 are opposed to each other while sandwiching the substantially upper side half part of the blade 100 therebetween, and the second support part 106 and the second reinforcement part 115 are opposed to each other. The substantially lower side half part of the blade 100 is protruded downward from between the first support part 105 and the first reinforcement part 114. Herein, the first reinforcement part 114 (reinforcement member 102) is provided at a side opposite to the first support part 105 (support member 101) with respect to the blade 100.

Next, the attachment of the layer thickness regulating member 23 to the developing frame 40 (refer to FIG. 6) will be described. At this time, the developing roller 22 is not attached to the developing frame 40.

First, before attaching the layer thickness regulating member 24, from the front side, a seal member 119 is attached to the opposing surface 66 (refer to FIG. 6) of the second frame 47 of the developing frame 40 (refer to FIG. 3). The seal member 119 is made of sponge and the like, and has a band shape that is elongated in the width direction and a dimension that is the substantially same as the opposing surface 66, when seen from a front face. Portions of the seal member 119, which are downwardly protruded from the opposing surface 66, are attached to the front side end surfaces (surfaces flush with the opposing surface 66) of the lower end portions 65A of the four protrusions 65.

Then, the layer thickness regulating member 24 is provided above the front end portion of the first ceiling wall 61 of the developing frame 40 (refer to FIG. 6) and is then lowered. Thus, from the upper, the second support part 106 and the second reinforcement part 115 of the layer thickness regulating member 24 are fitted into the recess part 88 between the left and right screw parts 50 on the ceiling surface of the developing frame 40, so that the layer thickness regulating member is opposed to the first ceiling wall 61 at an interval, from the upper (refer to FIG. 6). In addition, the substantially lower side half parts of the respective screws 118, which are downwardly protruded through the screw holes 112, are fitted into the receiving holes 64 (refer to FIG. 6) located at the same position in the width direction on the first ceiling wall 61, from the upper. At this time, each screw 118 is not contacted to the first ceiling wall 61 (a part of defining the receiving hole 64).

In addition, in the support member 101 of the layer thickness regulating member 24, the left and right protrusions 108 (refer to FIG. 8) are, from the front side, opposed to the front end surfaces of the screw parts 50 (refer to FIG. 6) of the developing frame 40 located at the same position in the width direction, and the attachment holes 110 (refer to FIG. 8) of the protrusions 108 are, from the front side, opposed to the bosses 51 and screw holes 52 (refer to FIG. 6) of the corresponding screw parts 50. In addition, the first support part 105 of the support member 101 and the substantially lower side half part of and the blade 100 are opposed to the seal member 119 (in other words, opposing surface 66 having the seal member 119 attached thereon) from the front side (refer to FIG. 3).

In this state, the entire layer thickness regulating member 24 is displaced in the rear direction in parallel. Thereby, the substantially lower side half part of each screw 118 is moved rearward in the receiving hole 64 (refer to FIG. 6) and is arranged at the rear end portion of the receiving hole 64. At this time, each screw 118 is still not contacted to the first ceiling wall 61 (a part of defining the receiving hole 64). That is, each receiving hole 61 receives the screw 118 with allowance in the attachment direction (rearward direction) of the layer thickness regulating member 24 (protrusions 108) to the developing frame 40.

At this time, the first support part 105 and the substantially lower side half part of the blade 100 press the seal member 119 to the opposing surface 66 of the rear side thereof, so that the seal member 119 is compressed between the substantially lower side half part of the blade 100 and the first support part 105 and the front end surfaces of the lower end portions 65A of the convex portions 65 and the opposing surface 66 (refer to FIG. 3). In addition, the bosses 51 (refer to FIG. 6) of the screw parts 50 are fitted into the attachment holes 110 (refer to FIG. 8) of the left and right protrusions 108, from the back side, and the bosses 51 and the screw holes 52 are exposed forward through the attachment holes 110 (refer to FIG. 8).

Additionally, at this time, the recesses 53 of the widthwise outer end portions on the front end surfaces (surfaces of the developing frame 40 opposed to the layer thickness regulating member 24) of the respective screw parts 50, which are opposed to the protrusions 108 (refer to FIG. 8), and the widthwise outer end edges of the corresponding protrusions 108 conform to each other, when seen from a front face (refer to FIG. 4). Therefore, even if there is a burr at the widthwise outer end edge of the protrusion 108, the burr is put into the recess 53.

Finally, when the screws 120 (refer to FIG. 3) are assembled, from the front side, into the screw holes 52 (refer to FIG. 6) of the bosses 51 of the left and right screw parts 50, the left and right protrusions 108 are sandwiched from the front side and back side by the head parts of the screws 120 and the screw parts 50, respectively. Accordingly, the layer thickness regulating member 24 is attached to the developing frame 40 only at the left and right protrusions 108. Herein, since the screws 120 are above the blade 100 and are not contacted to the blade 100 (refer to FIG. 3), the force of assembling the screws 120 into the screw parts 50 does not act on the blade 100, which causes bending in the blade 100.

At this time, since the left and right protrusions 108 are attached to the screw parts 50 at the same position in the width direction, the support member 101 (refer to FIG. 9) having the left and right protrusions 108 integrated thereto are placed between the left and right screw parts 50, i.e., left and right sidewalls 42. Herein, as described above, since the left and right screw parts 50 are located at the same position as the developing chamber 77 in the front-rear direction, the support member 101 is placed between the sidewalls 42 in the developing chamber 77 (refer to FIG. 3).

In addition, at this time, the blade 100 of the layer thickness regulating member 24 is provided in the width and vertical directions. Additionally, the second support part 106 and the second reinforcement part 115 reach the deepest portion of the recess part 88 of the ceiling surface of the developing frame 40 and are adjacent to the first ceiling wall 61 from the upper with a slight interval therebetween (refer to FIG. 3). In addition, the first support part 105 (excluding the left and right protrusions 108) and the first reinforcement part 114 are opposed to the front end surface (opposing surface 66) of the first ceiling wall 61 from the front side while interposing the seal member 119 therebetween (refer to FIG. 3). Additionally, the left and right protrusions 108 are opposed, from the front side, to the front end surfaces of the screw parts 50 at the same position in the width direction.

In other words, when seen from a front face, the first support part 105 and the first reinforcement part 114 conform to the opposing surface 66, and the left and right protrusions 108 conform to the corresponding screw parts 50 (refer to FIG. 3). Therefore, the recess part 88 of the developing frame 40, which is defined by the first ceiling wall 61 and the left and right screw parts 50 is downwardly recessed along the U-shape defined by the first support part 105 (first reinforcement part 114) and the protrusions 108.

When the developing roller 22 is attached to the developing frame 40, the back side and upper circumferential surface of the rubber roller 22B of the developing roller 22 is press-contacted to the pushing part 104 (refer to FIG. 8) of the lower end portion of the blade 100 from the front side. Thus, the substantially lower side half part of the blade 100 (a part that is not sandwiched by the first reinforcement part 114 and the first support part 105) is slightly bent rearward. By the restoring force (elastic force) caused to the blade 100, the pushing part 104 presses the rear and upper circumferential surface of the developing roller 22 (rubber roller 22B) over the entire width thereof, from the back side, as shown in FIG. 10. In other words, the blade 100 is provided in the width direction and is contacted at the pushing part 104 to the circumferential surface of the rubber roller 22B along the width direction.

That is, in the state where the developing roller 22 and the layer thickness regulating member 24 are attached to the developing frame 40 and thus the developing cartridge 16 is completed (refer to FIG. 4), the first support part 105 of the support member 101 is located at a position opposite to the developing roller 22 with respect to the blade 100. In addition, the left and right protrusions 108 (refer to FIG. 8) of the support member 101 are further protruded than the first support part 105 and the reinforcement member 102 in the upper direction that becomes more distant from the developing roller 22.

In addition, in this state, as viewed from the width direction, the coupling gear 83 indicated by the dotted line is overlapped with the bending portion 101A of the support member 101 and is overlapped with the entire support member 101 except the protrusions 108. Additionally, as viewed from the width direction, if it is assumed a rectangular area Z (square or rectangle), two sides of which are defined by the L-shaped support member 101, the rotation center 83A of the coupling gear 83 is located in the rectangular area Z.

(3) Attaching of Developing Cartridge on Drum Cartridge

Next, the attaching and detaching of the developing cartridge 16 to and from the drum cartridge 15 will be described. The attaching and detaching of the developing cartridge 16 to and from the drum cartridge 15 is performed at the outside of the body casing 2 (refer to FIG. 1).

Referring to FIG. 2, when attaching the developing cartridge 16 to the drum cartridge 15, a user first holds the handle 74 and arranges the developing cartridge 16 above the attachment and detachment opening 31 of the drum cartridge 15.

Then, the user lowers the developing cartridge 16 so that the developing roller 22 of the front end first passes through the attachment and detachment opening 31, and then the developing cartridge 16 is received in the cartridge housing chamber 35 of the drum cartridge 15. At this time, the left and right pushing bosses 38 of the developing cartridge 16 are contacted to the pushing members 36, which are located at the same position of the drum cartridge 15 in the width direction, from the front-upper side. Thereby, each pushing member 36 resists against the force applied by the pressing member (not shown) and thus is biased in the clockwise direction, when seen from the width direction.

As shown in FIG. 2, when the developing cartridge 16 is completely received in the cartridge housing chamber 35, the attaching of the developing cartridge 16 to the drum cartridge 15 is completed.

In this state, the front side circumferential surface of the rubber roller 22B of the developing roller 22 of the developing cartridge 16 is exposed to the front side through the opening 75 of the developing frame 40 and is opposed to the back side circumferential surface of the photosensitive drum 16 of the drum cartridge 15 over the entire widthwise area, from the back side.

In addition, at this time, each pushing member 36 is biased to rotate in the counterclockwise direction, when seen from the width direction, toward its original position before the attaching of the developing cartridge 16, due to the force applied by the pressing member (not shown), and pushes the pushing boss 38 in the front direction along the substantially horizontal direction. Thereby, since the overall developing cartridge 16 is forced in the front direction, the developing roller 22 (rubber roller 22B) is pushed toward the photosensitive drum 17 and the front side circumferential surface of the rubber roller 22B is press-contacted to the back side circumferential surface of the photosensitive drum 17 over the entire widthwise area, from the back side.

Here, the direction in which the pushing member 36 pushes the pushing boss 38, i.e., the pushing direction P of the developing roller 22 to the photosensitive drum 17 is a direction toward the front side along the substantially horizontal direction, as viewed from the width direction, as indicated by the thick dotted arrow. Since the second support part 106 of the layer thickness regulating member 24 is extended in the substantially horizontal direction, as described above, it can be seen that the second support part is extended from the upper end portion of the first support part 105 along the pushing direction, as viewed from the width direction.

In addition, in the state where the developing cartridge 16 is attached to the drum cartridge 15, the recess part 88 of the ceiling surface of the developing cartridge 16 is upwardly exposed through the attachment and detachment opening 31 of the drum cartridge 15 and are directed toward the circumferential surface of the photosensitive drum 17 from the rear-upper direction (refer to FIG. 1).

In the meantime, when the user pulls out the developing cartridge 16 through the attachment and detachment opening 31 of the drum cartridge 15 while holding the handle 74, it is possible to detach the developing cartridge 16 from the drum cartridge 15.

(4) Operation in Developing Cartridge

Referring to FIG. 3, when forming an image, the toner in the toner accommodating chamber 78 is conveyed to the front side developing chamber 77 while being stirred by rotation of the agitator 41 and then supplied to the supply roller 23. Then, the toner is supplied to the developing roller 22 by rotation of the supply roller 23 in the developing chamber 77, and is carried on the circumferential surface of the rubber roller 22B of the developing roller 22.

Herein, since the developing roller 22 is rotated in the counterclockwise direction, when seen from the right side, as described above, the toner carried on the circumferential surface of the rubber roller 22B of the developing roller 22 is supplied between the pushing part 104 at the lower end portion of the blade 100 of the layer thickness regulating member 24 and the circumferential surface of the developing roller 22 (rubber roller 22B) from the rear-lower direction, as the developing roller 22 is rotated. While a layer thickness of the toner is regulated between the pushing part 104 and the circumferential surface of the developing roller 22 (rubber roller 22B), the toner is carried as a thin layer on the circumferential surface of the developing roller 22 (rubber roller 22B), as described above.

In other words, as the pushing part 104 contacts the circumferential surface of the developing roller 22 over the entire widthwise area, the blade 100 regulates the layer thickness of the toner on the circumferential surface of the developing roller 22.

Herein, since the gap between the developing roller 22 and the bottom wall 44 of the developing frame 40 is sealed by the lower film 80 and the gap between the blade 100 and the opposing surface 66 of the developing frame 40 is sealed by the seal member 119, the toner is not leaked through those gaps.

In addition, the left and right side seals (not shown) are contacted to the both widthwise end portions of the back side circumferential surface of the developing roller 22 (rubber roller 22B), from the back side. Therefore, when the developing roller 22 is rotated at the corresponding state, the back side circumferential surface of the both widthwise end portions of the developing roller 22 (rubber roller 22B) slides while contacting each side seal. At this time, the toner leakage is prevented to the widthwise outside from the area sandwiched between the left and right side seals on the circumferential surface of the rubber roller 22B. In other words, the left and right side seals prevent the toner from being leaked at the both widthwise end portions of the developing roller 22.

As described above, the thin toner layer carried on the circumferential surface of the developing roller 22 is supplied to the electrostatic latent image formed on the circumferential surface of the photosensitive drum 17 (refer to FIG. 1). Herein, referring to FIG. 1 with respect to the formation of the electrostatic latent image on the photosensitive drum 17, the laser beam irradiated on the surface of the photosensitive drum 17 from the exposure unit 12 is extended in the linear shape in the front-lower direction, as indicated by the dotted arrow, passes through the recess part 88 of the ceiling surface of the developing cartridge 16 and reaches the circumferential surface of the photosensitive drum 17. In other words, the light path L of the laser beam to the photosensitive drum 17 from the exposure unit 12 passes through the recess part 88, i.e., between the left and light protrusions 108 (refer to FIG. 4) of the support member 101.

3. Operational Effects (1) Referring to FIG. 3, in the developing cartridge 16, the developing roller 22 configured to carry toner on the circumferential surface is rotatably supported by the developing frame 40. In addition, the developing cartridge 16 includes the layer thickness regulating member 24.

The layer thickness regulating member 24 includes the blade 100 configured to contact the circumferential surface of the developing roller 22 over the entire area of the rotational axial direction (width direction) of the developing roller 22 and thus regulates a layer thickness of toner on the circumferential surface of the developing roller 22, and the support member 101 that supports the blade 100.

The support member 101 includes the first support part 105 which contacts the blade 100 and the protrusions 108 which are attached to the developing frame 40. The protrusions 108 are positioned at both widthwise end portions of the first support part 105 and are further protruded than the first support part 105 in a direction (upper direction) away from the developing roller 22 (refer to FIG. 9).

In other words, in the support member 101 of the layer thickness regulating member 24, the parts that are further protruded than the first support part 101 in a direction away from the developing roller 22 are only the protrusions 108 at both widthwise end portions of the first support part 101. Accordingly, compared to a case where a portion between the protrusions 108 at both end portions is also protruded, it is possible to reduce the size of the developing cartridge 16.

In addition, the layer thickness regulating member 24 is attached to the developing frame 40 only at the left and right protrusions 108, so that it is possible to reduce the attachment space of the layer thickness regulating member 24 in the developing frame 40 into only the left and right screw parts 50. Therefore, it is possible to reduce the entire size of the developing cartridge 16. In addition, the light path L of the laser beam passes between the left and right protrusions 108, so that it is possible to approach the light path L to the developing cartridge 16 (layer thickness regulating member 24) as close as possible. Therefore, it is possible to reduce the entire size of the printer 1, by the approached dimension (refer to FIG. 1).

As shown in FIG. 8, only the left and right protrusions 108 of the support member 101 of the layer thickness regulating member 24 are upwardly protruded. Thereby, in a case where the developing cartridge 16 shown in FIG. 4 is dropped to the ground or the developing cartridge 16 is attached and detached to and from the body casing 2 (refer to FIG. 1), even when an outside object collides with the layer thickness regulating member 24, the shock is received by the left and right protrusions 108 and does not act on the blade 100. Therefore, it is possible to prevent the blade 100 from being damaged.

In other words, it is possible to prevent the blade 100 from being damaged while securing the light path L (refer to FIG. 1) and the attachment space of the layer thickness regulating member 24 to the developing frame 40.

(2) Referring to FIG. 10, the layer thickness regulating member 24 has the reinforcement member 102 that is provided at an opposite side to the support member 101 with respect to the blade 100 and reinforces the blade 100.

Herein, both the support member 101 and the reinforcement member 102 are bent, as viewed from the width direction. Accordingly, it is possible to increase the rigidity of each of the support member 101 and the reinforcement member 102 and to reduce the height of the support member 101 and the reinforcement member 102 (in other words, the entire height of the layer thickness regulating member 24) to be small.

In the support member 101, one side with respect to the bending portion 101A configures the first support part 105 and the other side with respect to the bending portion 101A configures the second support part 106. Additionally, in the reinforcement member 102, one side with respect to the bending portion 102A configures the first reinforcement part 114 and the other side with respect to the bending portion 102A configures the second reinforcement part 115.

The first support part 105 and the first reinforcement part 114 sandwich the blade 100 therebetween while opposing each other, and the second support part 106 and the second reinforcement part 115 are fixed while opposing each other. Thereby, the blade 100 sandwiched by the first support part 105 and the first reinforcement part 114 is provided at an opposite side to the fixed part of the second support part 106 and the second reinforcement part 115 (fixed part of the support member 101 and the reinforcement member 102) with respect to the bending portions 101A, 102A of the support member 101 and the reinforcement member 102. Therefore, it is possible to separate the blade 100 from the fixed part.

Accordingly, when fixing the second support part 106 and the second reinforcement part 115 by the screws 118, as in the above-described illustrative embodiment, it is possible to prevent the problem that the force, by which the screws 118 fix the second support part 106 and the second reinforcement part 115 at the fixed part acts on the blade 100 and thus the blade 100 is unnecessarily bent (waved).

(3) The first support part 105, which sandwiches the blade 100 together with the first reinforcement part 114 (i.e., contacts the blade 100 and thus supports the blade 100), is provide at the opposite side to the developing roller 22 with respect to the blade 100. Therefore, the force, by which the developing roller 22 presses the blade 100 at the front side can be supported by the first support part 105 from the downstream side (back side) of the force acting direction. Thus, it is possible to prevent the position of the blade 100 from being dislocated by the force. Thereby, it is possible to improve the positioning precision of the blade 100 with respect to the circumferential surface of the developing roller 22.

Additionally, both widthwise end portions of the first support part 105 are provided with the protrusions 108 that are provide on the same plane Y as the first support part 105 and are further protruded than the reinforcement member 102 in a direction away from the developing roller 22 (refer to FIG. 9). In other words, the protrusions 108 attached to the developing frame 40 (refer to FIG. 4) and the first support part 105 supporting the blade 100 are provide on the same plane Y. Therefore, when the protrusions 108 are attached to the developing frame 40 with high precision, it is possible to provide the first support part 105 (blade 100) at a desired position with high precision also. As a result, it is possible to further improve the positioning precision of the blade 100 to the circumferential surface of the developing roller 22.

(4) As shown in FIG. 4, in the layer thickness regulating member 24, only the protrusions 108 of the support member 101 are attached to the developing frame 40. Therefore, compared to a case where the other parts (for example, reinforcement member 102 and the like) of the layer thickness regulating member 24 except the protrusions 108 are also attached to the developing frame 40, it is possible to attach the entire layer thickness regulating member 24 to the developing frame 40 with high precision just by attaching the protrusions 108 to the developing frame 40 with high precision (in other words, it is possible to position the blade 100 with respect to the circumferential surface of the developing roller 22 with high precision).

(5) The developing frame 40 is formed with the recess part 88 that is recessed along the U-shaped pattern defined by the first support part 105 (refer to FIG. 9) and the protrusions 108. Accordingly, it is possible to reduce the size of the developing cartridge 16, correspondingly to the recess part 88.

(6) The second support part 106 and the second reinforcement part 115 are assembled by the screws 118 (refer to FIG.

10). Correspondingly to this, the developing frame 40 is formed with the receiving holes 64 that receive the screws 118, as shown in FIG. 6.

Herein, the receiving holes 64 can receive the screws 118 (refer to FIG. 10) with allowance in the attachment direction (front-rear direction) of the protrusions 108 (in other words, the entire layer thickness regulating member 24) to the developing frame 40. Therefore, in attaching the layer thickness regulating member 24 (refer to FIG. 8) to the developing frame 40, it is possible to prevent the screws 118 from being caught in the developing frame 40 during the attachment, by inserting the screws 118 having assembled with the second support part 106 and the second reinforcement part 115 into the receiving holes 64 and then attaching the protrusions 108 (layer thickness regulating member 24) to the developing frame 40.

In the developing frame 40, the parts (the lower end portions 65A of the convex parts 65) corresponding to the deepest parts of the receiving holes 64 are extended up to the opposing surface 66 of the developing frame 40, which opposes the blade 100. Referring to FIG. 3, the seal member 119 is provided at a space (hereinafter, referred to as "gap") between the lower end portions 65A (front end faces of the lower end portions 65A) and opposing surface 66 and the blade 100. Thereby, it is possible to prevent toner from entering the gap. In the developing frame 40, not only the opposing surface 66 but also the front end faces of the lower end portions 65A of the convex parts 65 support the seal member 119. Therefore, it is possible to stabilize the position of the seal member 119 provided at the gap.

(7) Referring to FIG. 4, the recesses 50 are formed at the parts corresponding to the end edges of the protrusions 108 on the surfaces (front end faces of the left and right screw parts 50) of the developing frame 40, which opposes the layer thickness regulating member 24. Therefore, even when the protrusions 108 having a burr at the end edges are attached to the developing frame 40, the burr is received in the recesses 53. Thus, the burr does not have a bad influence on the attachment precision of the protrusions 108 (layer thickness regulating member 24) to the developing frame 40 (in other words, the positioning precision of the blade 100 to the circumferential surface of the developing frame 40).

(8) Referring to FIG. 1, in the printer 1, the exposure unit 12 irradiates the circumferential surface of the photosensitive drum 17 with light to expose it, thereby forming an electrostatic latent image on the circumferential surface of the photosensitive drum 17. Herein, the light path L from the exposure unit 12 to the photosensitive drum 17 passes between the pair of protrusions 108 (refer to FIG. 4). Therefore, it is possible to approach the light path L to the layer thickness regulating member 24 (i.e., developing cartridge 16). Thus, it is possible to reduce the size of the printer 1, by the approached dimension.

4. Modified Illustrative Embodiment

While the present invention has been shown and described with reference to certain exemplary embodiments thereof, it will be understood by those skilled in the art that various changes in form and details may be made therein without departing from the spirit and scope of the invention as defined by the appended claims.

In the above illustrative embodiment, in the layer thickness regulating member 24, the second support part 106 of the support member 101 and the second reinforcement part 115 of the reinforcement member 102 are fixed by the screws 118 (refer to FIG. 10). However, the second support part and the second reinforcement part may be fixed (welded) by welding.

Additionally, in the above illustrative embodiment, the blade 100 is fixed to the first support part 105 by being sandwiched between the first reinforcing part 114 of the reinforcement member 102 and the first support part 105. However, the blade 100 may be fixed to the first support part 105 by welding. In this case, the reinforce member 102 may be omitted.

Figure 11:
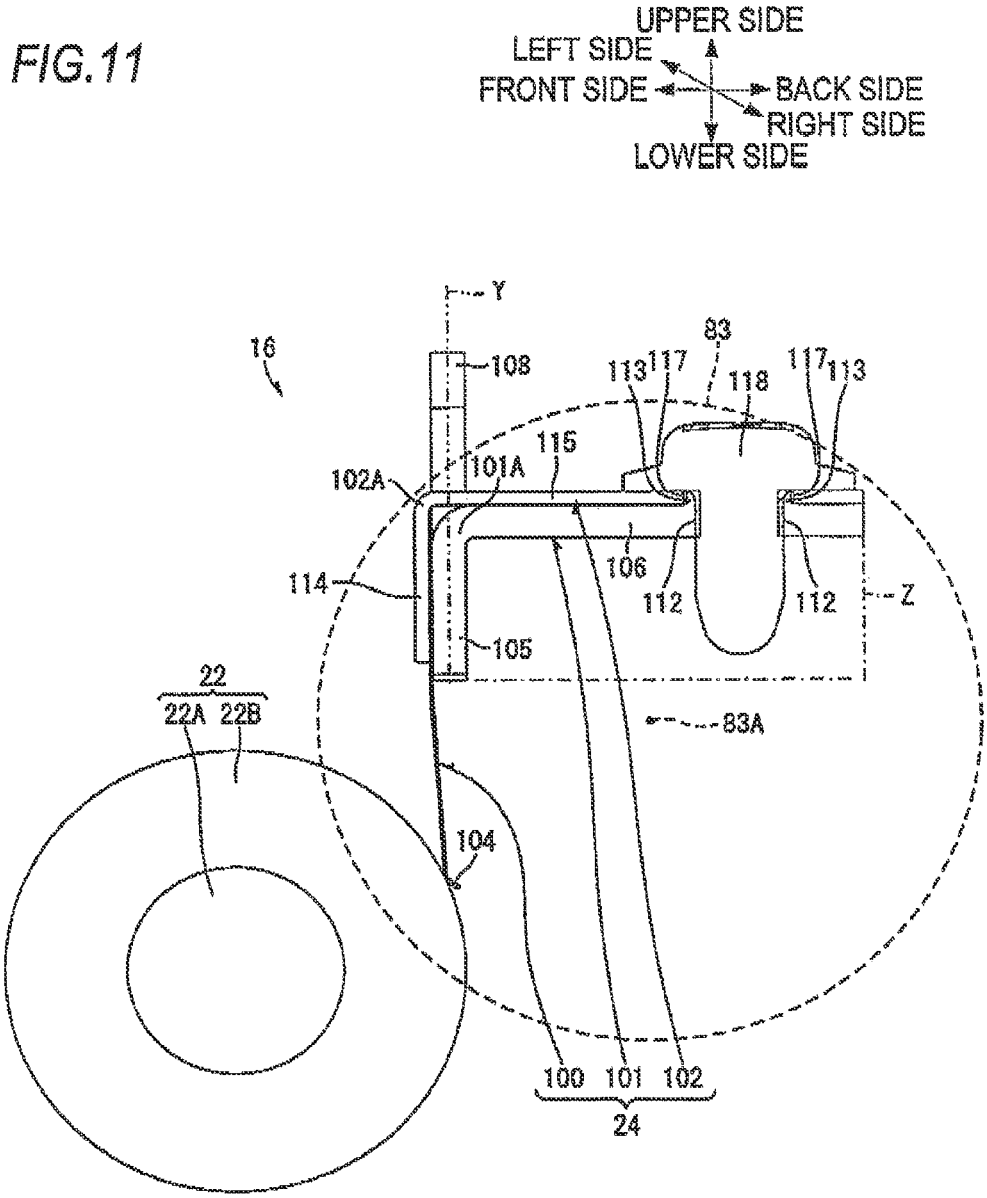
FIG. 11 is a right side sectional view of the layer thickness regulating member and the developing roller according to a modified illustrative embodiment.

In the above illustrative embodiment, the rotation center 83A of the coupling gear 83 is located in the rectangular area Z which is defined by the L-shaped support member 101. However, as shown in FIG. 11, the rotation center 83A of the coupling gear 83 may be located outside the rectangular area Z.

Figure 12:
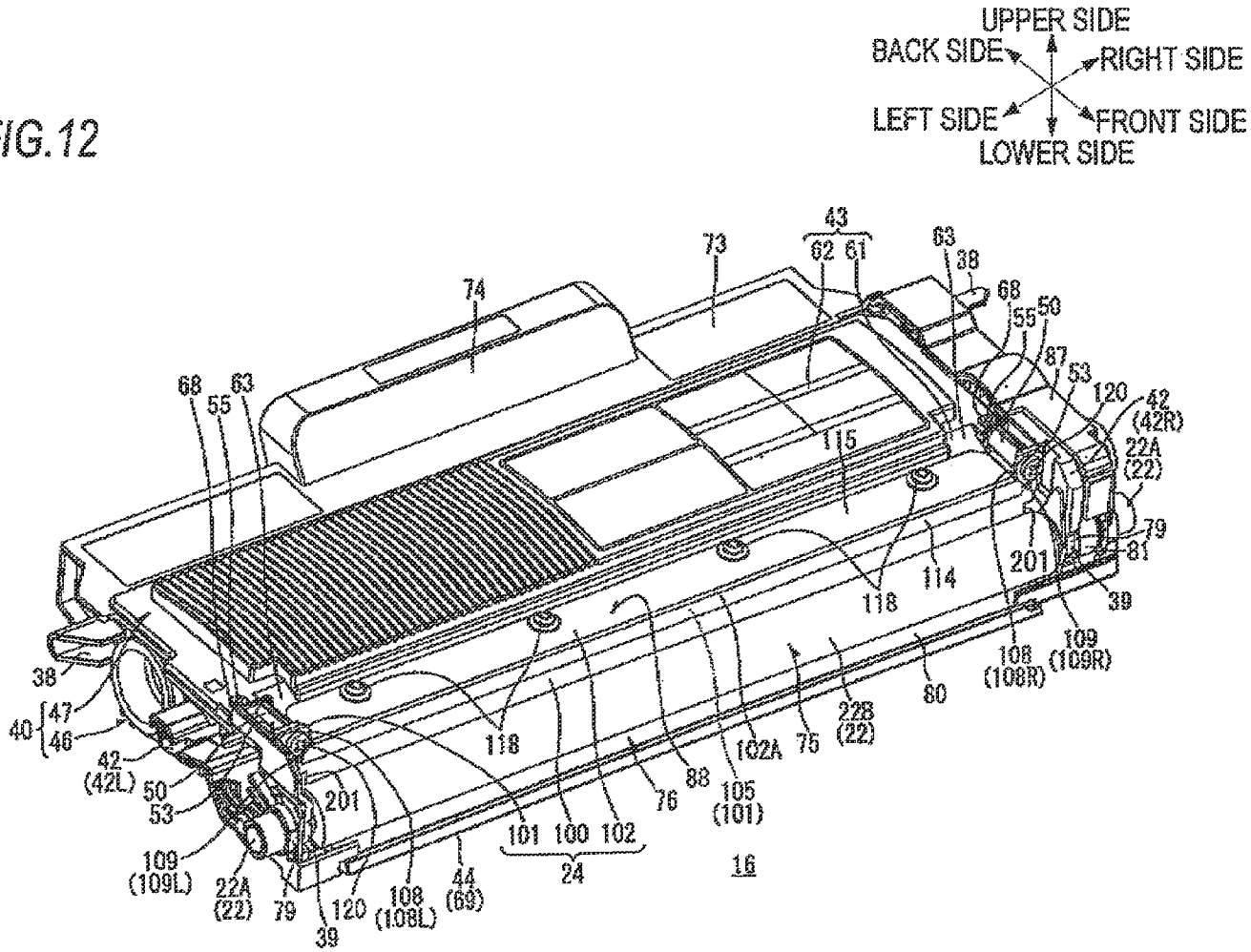
FIG. 12 is a perspective view of a developing cartridge including a layer thickness regulating member according to a modified illustrative embodiment, which is seen from a front-left upper direction.

In addition, as shown in FIG. 4, the pushing part 104, which is the lower end portion (leading end portion) of the blade 100, has the widthwise dimension, which is the substantially same as the widthwise dimension of the rubber roller 22B of the developing roller 22, and the circumferential surface of the rubber roller 22B is pressed over the entire area of the width direction by the pushing part 104. However, as shown in FIG. 12, both widthwise end portions of the lower end portion of the blade 100 may be notched and thus the pushing part 104 has the widthwise dimension smaller than the widthwise dimension of the rubber roller 22B.

In this case, the pushing part 104 is not contacted to the circumferential surface of the rubber roller 22B over the entire area of the width direction, so that the circumferential surface of the rubber roller 22B has a part in which the pushing part 104 does not contact both widthwise end portions of the rubber roller 22B. Therefore, it is preferable that the widthwise dimension of the pushing part 104 is equal to or greater than the widthwise dimension of an image forming area of the surface of the photosensitive drum 17, on which an electrostatic latent image is formed, and the pushing part 104 contacts an entire part of the developing roller 22 (rubber roller 22B) in the width direction, which contacts the image forming area.

The invention claimed is:

1. A developer cartridge comprising:

a housing configured to accommodate developer therein;

a developing roller configured to be rotatable about an axis extending in a first direction;

a blade extending in a second direction, the blade having a first end in the second direction and a second end separated from the first end in the second direction, the first end being closer to a circumferential surface of the developing roller than the second end; and a metal plate extending in the first direction, the metal plate being attached to the second end of the blade, the metal plate having a third end in the first direction and a fourth end separated from the third end in the first direction, the metal plate including:

a first protrusion protruding from the third end in the second direction, the first protrusion being positioned at an opposite side of the first end relative to the second end, the first protrusion having a first hole, the first hole being positioned at a distal end of the first protrusion;

a second protrusion protruding from the fourth end in the second direction, the second protrusion being positioned at an opposite side of the first end relative to the second end, the second protrusion having a second hole, the second hole being positioned at a distal end of the second protrusion;

a first screw inserted into the first hole, the first screw attaching the first protrusion to the housing; and a second screw inserted into the second hole, the second screw attaching the second protrusion to the housing.

2. The developer cartridge according to claim 1, wherein the first hole is separated from the blade in the second direction, and wherein the second hole is separated from the blade in the second direction.

3. The developer cartridge according to claim 1, wherein the metal plate fixes the blade.

4. The developer cartridge according to claim 1, wherein the metal plate further includes:

a support member extending from the metal plate in a third direction perpendicular to both the first direction and the second direction, the support member being positioned between the first protrusion and the second protrusion.

* * * * *